US008537086B2

(12) United States Patent
Koyama et al.

(10) Patent No.: US 8,537,086 B2
(45) Date of Patent: Sep. 17, 2013

(54) DRIVING METHOD OF LIQUID CRYSTAL DISPLAY DEVICE

(75) Inventors: Jun Koyama, Sagamihara (JP); Shunpei Yamazaki, Setagaya (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 282 days.

(21) Appl. No.: 13/150,728

(22) Filed: Jun. 1, 2011

(65) Prior Publication Data

US 2011/0310133 A1 Dec. 22, 2011

(30) Foreign Application Priority Data

Jun. 16, 2010 (JP) ..... 2010-136755

(51) Int. Cl.
*G09G 3/36* (2006.01)

(52) U.S. Cl.
USPC ..... 345/88; 345/690

(58) Field of Classification Search
USPC ..... 345/88, 690
See application file for complete search history.

(56) References Cited

U.S. PATENT DOCUMENTS

| | | | | |
|---|---|---|---|---|
| 6,597,348 | B1 | 7/2003 | Yamazaki et al. | |
| 7,317,438 | B2 | 1/2008 | Yamazaki et al. | |
| 7,385,579 | B2 | 6/2008 | Satake | |
| 7,403,177 | B2 | 7/2008 | Tanada et al. | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 7,990,403 | B2 * | 8/2011 | Ben-David et al. | 345/694 |
| 8,228,275 | B2 * | 7/2012 | Langendijk | 345/88 |
| 8,253,651 | B2 * | 8/2012 | Pai | 345/3.2 |
| 2005/0270444 | A1 * | 12/2005 | Miller et al. | 349/108 |
| 2007/0279374 | A1 | 12/2007 | Kimura et al. | |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |

FOREIGN PATENT DOCUMENTS

| | | | |
|---|---|---|---|
| JP | 2006-220685 | A | 8/2006 |
| JP | 2007-264211 | A | 10/2007 |
| JP | 2009-042405 | | 2/2009 |
| JP | 2009-042405 | A | 2/2009 |

OTHER PUBLICATIONS

Baron.P et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Kevin M Nguyen
(74) *Attorney, Agent, or Firm* — Eric J. Robinson; Robinson Intellectual Property Law Office, P.C.

(57) ABSTRACT

To improve the quality of a liquid crystal display device, writing of an image signal and lighting of a backlight are sequentially performed not in the whole pixel portion of the liquid crystal display device but in each given region of the pixel portion. Thus, the frequency of input of an image signal to each pixel of the liquid crystal display device can be increased. As a result, display degradation caused in the liquid crystal display device such as color break can be suppressed, and the quality of an image can be improved.

12 Claims, 17 Drawing Sheets

(56) References Cited

OTHER PUBLICATIONS

Kurita.T et al., "Evaluation and Improvement of Picture Quality for Moving Images on Field-sequential Color Displays," IDW '00: Proceedings of the 17th International Display Workshops, 2000, pp. 69-72.

Taira.K et al., "A15 Field-Sequential Display without Color Break-Up using an AFLC Color Shutter," IDW '00: Proceedings of the 17th International Display Workshops, 2000, pp. 73-76.

Jarvenpaa.T, "7.2: Measuring Color Breakup of Stationary Images in Field-Sequential-Color Displays," SID Digest '04: SID International Symposium Digest of Technical Papers, 2004, vol. 35, pp. 82-85.

* cited by examiner

DRIVING METHOD OF LIQUID CRYSTAL DISPLAY DEVICE

BACKGROUND OF THE INVENTION

1. Field of the Invention

The present invention relates to a driving method of a liquid crystal display device. In particular, the present invention relates to a driving method of a field-sequential liquid crystal display device.

2. Description of the Related Art

As display methods of liquid crystal display devices, a color filter method and a field sequential method are known. In a color-filter liquid crystal display device, a plurality of subpixels which have color filters for transmitting only lights of wavelengths with given colors (e.g., red (R), green (G), and blue (B)) are provided in each pixel. A desired color is expressed by control of transmission of white light in each subpixel and mixture of a plurality of colors in each pixel. In contrast, in a field-sequential liquid crystal display device, a plurality of light sources that emit lights of different colors (e.g., red (R), green (G), and blue (B)) are provided. A desired color is expressed in such a manner that the plurality of light sources is repeatedly turned on and off and transmission of light of each color is controlled in each pixel. In other words, the color filter method is a method by which a desired color is expressed by division of one pixel among lights of given colors, and the field sequential method is a method by which a desired color is expressed by division of a display period among lights of given colors.

The field-sequential liquid crystal display device has the following advantages over the color-filter liquid crystal display device. First, in the field-sequential liquid crystal display device, it is not necessary to provide subpixels in each pixel. Thus, the aperture ratio can be increased or the number of pixels can be increased. Further, in the field-sequential liquid crystal display device, it is not necessary to provide color filters. In other words, light loss due to light absorption in the color filters does not occur. Therefore, transmittance can be improved and power consumption can be reduced.

Patent Document 1 discloses a field-sequential liquid crystal display device. Specifically, Patent Document 1 discloses a liquid crystal display device in which each pixel includes a transistor for controlling input of an image signal, a signal storage capacitor for holding the image signal, and a transistor for controlling transfer of an electrical charge from the signal storage capacitor to a display pixel capacitor. In the liquid crystal display device with the structure, writing of an image signal to the signal storage capacitor and display based on an electrical charge held in the display pixel capacitor can be performed concurrently.

REFERENCE

Patent Document 1: Japanese Published Patent Application No. 2009-42405

SUMMARY OF THE INVENTION

As described above, in the field-sequential liquid crystal display device, color information is time-divided. Thus, display viewed by a user might be changed (deviated) from display based on original display data (such a phenomenon is also referred to as color break or color breakup) due to lack of given display data that is caused by block of display in a short time (e.g., blink of the user). An object of one embodiment of the present invention is to suppress a decrease in the image quality of a field-sequential liquid crystal display device.

One embodiment of the present invention is a driving method of a liquid crystal display device including the step of forming an image in a pixel portion by repeatedly turning on and off a plurality of light sources emitting different colors and controlling transmission of light of different colors in each of a plurality of pixels provided in m rows and n columns (m and n are natural numbers that are 4 or more). Transmission of light emitting a first color in the plurality of pixels in first to β-th rows (B is a natural number that is A/2 or less) and transmission of light emitting a second color in the plurality of pixels in (A+1)th to (A+B)th rows (A is a natural number that is m/2 or less) are controlled, after an image signal for the first color and an image signal for the second color are input to the plurality of pixels in the first to B-th rows and to the plurality of pixels in the (A+1)th to (A+B)th rows, respectively, in a period when the image signal for the first color and the image signal for the second color are input to the plurality of pixels in the first to A-th rows and to the plurality of pixels in the (A+1)th to 2A-th rows, respectively. The light emitting the first color or the light emitting the second color is white light.

According to one embodiment of the present invention, writing of an image signal and lighting of a backlight are sequentially performed not in the whole pixel portion of the liquid crystal display device but in each given region of the pixel portion in a liquid crystal display device. Thus, the frequency of input of an image signal to each pixel of the liquid crystal display device can be increased. As a result, display degradation caused in the liquid crystal display device such as color break can be suppressed, and the quality of an image can be improved.

DETAILED DESCRIPTION OF THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiments below.

Note that liquid crystal display devices described below can be used for liquid crystal display devices with various liquid crystal modes. Specifically, a TN (twisted nematic) liquid crystal display device, a VA (vertical alignment) liquid crystal display device, an OCB (optically compensated birefringence) liquid crystal display device, an IPS (in-plane switching) liquid crystal display device, an MVA (multi-domain vertical alignment) liquid crystal display device, or the like can be used. Alternatively, liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase is only generated within a narrow range of temperature, a chiral agent or an ultraviolet curable resin is added so that the temperature range is improved. The liquid crystal composition which includes a liquid crystal showing a blue phase and a chiral agent is preferable because it has a small response time of greater than or equal to 10 μsec and less than or equal to 100 μsec, has optical isotropy, which makes the alignment process unneeded, and has a small viewing angle dependence.

Embodiment 1

In this embodiment, a liquid crystal display device which is one embodiment of the present invention will be described with reference to FIGS. 1A and 1B, FIGS. 2A to 2C, FIGS. 3A to 3D, FIGS. 4A and 4B, FIG. 5, and FIG. 6.

<Configuration Example of Liquid Crystal Display Device>

Figure 1A:
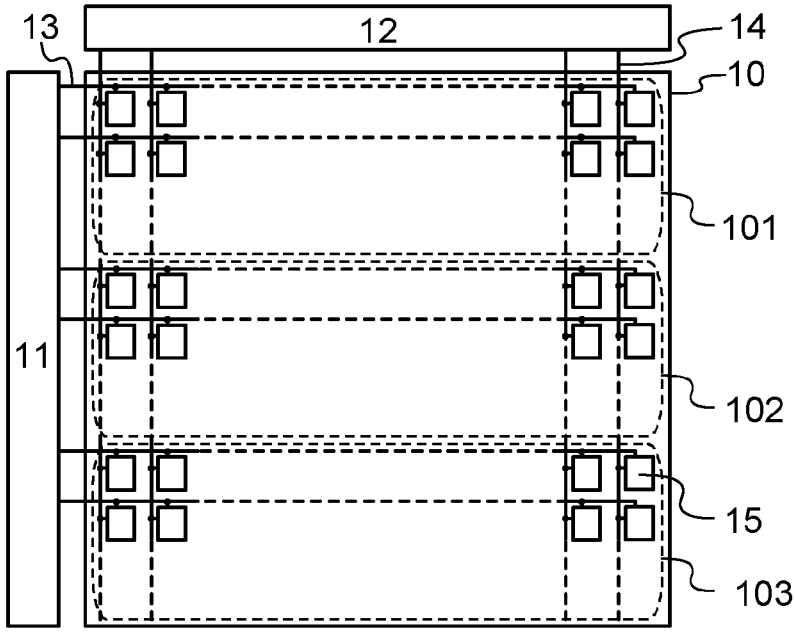
FIG. 1A illustrates a configuration example of a liquid crystal display device.

FIG. 1A illustrates a configuration example of a liquid crystal display device. The liquid crystal display device illustrated in FIG. 1A includes a pixel portion 10; a scan line driver circuit 11; a signal line driver circuit 12; m scan lines 13 which are arranged parallel or almost parallel to each other and whose potentials are controlled by the scan line driver circuit 11; and n signal lines 14 which are arranged parallel or almost parallel to each other and whose potentials are controlled by the signal line driver circuit 12. The pixel portion 10 is divided into three regions (regions 101 to 103), and each region includes a plurality of pixels arranged in a matrix. Each of the scan lines 13 is electrically connected to n pixels provided in a given row among the plurality of pixels provided in m rows and n columns in the pixel portion 10. In addition, each of the signal lines 14 is electrically connected to m pixels provided in a given column among the plurality of pixels provided in m rows and n columns.

Figure 1B:
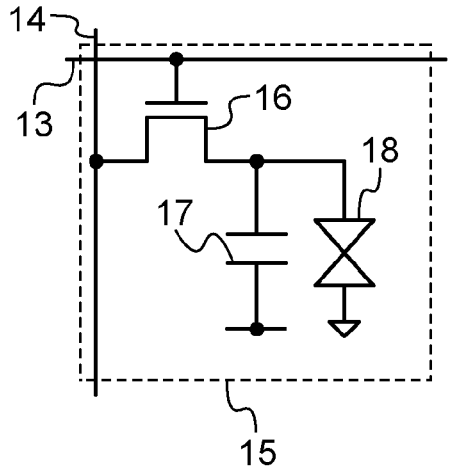
FIG. 1B illustrates a configuration example of a pixel.

FIG. 1B is an example of a circuit diagram of a pixel 15 included in the liquid crystal display device illustrated in FIG. 1A. The pixel 15 in FIG. 1B includes a transistor 16, a capacitor 17, and a liquid crystal element 18. A gate of the transistor 16 is electrically connected to the scan line 13. One of a source and a drain of the transistor 16 is electrically connected to the signal line 14. One electrode of the capacitor 17 is electrically connected to the other of the source and the drain of the transistor 16. The other electrode of the capacitor 17 is electrically connected to a wiring (also referred to as a capacitor line) that supplies a capacitor potential. One electrode (also referred to as a pixel electrode) of the liquid crystal element 18 is electrically connected to the other of the source and the drain of the transistor 16 and the one electrode of the capacitor 17. The other electrode (also referred to as a counter electrode) of the liquid crystal element 18 is electrically connected to a wiring that supplies a counter potential. The transistor 16 is an n-channel transistor. The capacitor potential and the counter potential can be the same potential.

<Configuration Example of Scan Line Driver Circuit 11>

Figure 2A:
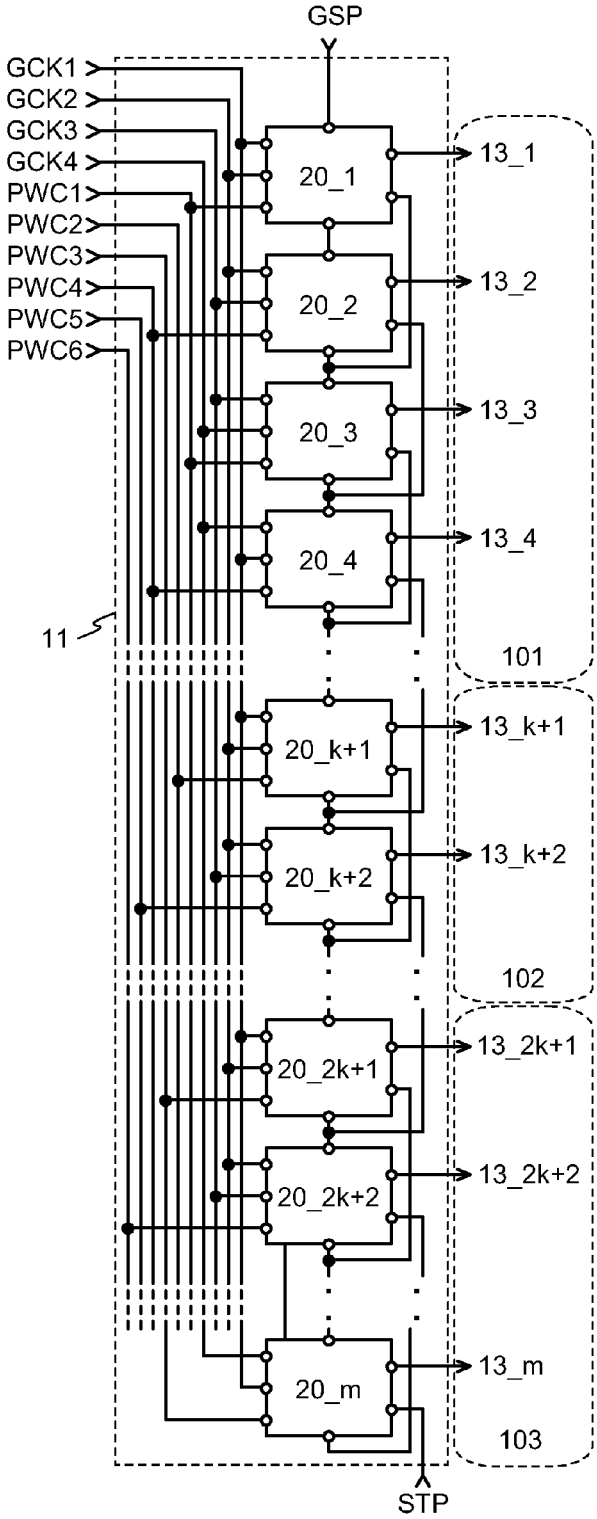
FIG. 2A illustrates a configuration example of a scan line driver circuit.

FIG. 2A illustrates a configuration example of the scan line driver circuit 11 included in the liquid crystal display device illustrated in FIG. 1A. The scan line driver circuit 11 in FIG. 2A includes wirings that respectively supply first to fourth scan line driver circuit clock signals (GCK1 to GCK4), wirings that respectively supply first to sixth pulse width control signals (PWC1 to PWC6), and first to m-th pulse output circuits 20_1 to 20_*m* that are connected to their respective scan lines 13 in the first to m-th rows. Note that here, the first to k-th pulse output circuits 20_1 to 20_*k* (k is a factor of 4 and less than m/2) are electrically connected to their respective scan lines 13 provided in the region 101. The (k+1)th to 2k-th pulse output circuits 20_(k+1) to 20_2k are electrically connected to their respective scan lines 13 provided in the region 102. The (2k+1)th to m-th pulse output circuits 20_(2k+1) to 20_*m* are electrically connected to their respective scan lines 13 provided in the region 103. Further, the first to m-th pulse output circuits 20_1 to 20_*m* each have a function of sequentially shifting a shift pulse in each shift period by using a scan line driver circuit start pulse (GSP) which is input to the first pulse output circuit 20_1 as a trigger. Further, a plurality of shift pulses can be shifted in the first to m-th pulse output circuits 20_1 to 20_*m* concurrently. In other words, even in a period in which a shift pulse is shifted in the first to m-th pulse output circuits 20_1 to 20_*m*, the scan line driver circuit start pulse (GSP) can be input to the first pulse output circuit 20_1.

Figure 2B:
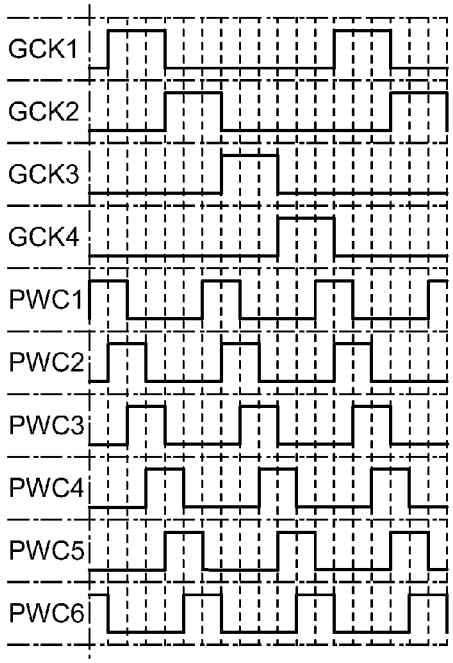
FIG. 2B is a timing diagram illustrating an example of a signal used for a scan line driver circuit.

FIG. 2B illustrates examples of specific waveforms of the above-described signals. The first scan line driver circuit clock signal (GCK1) illustrated in FIG. 2B periodically repeats a high-level potential (high power supply potential (Vdd)) and a low-level potential (low power supply potential (Vss)), and has a duty ratio of 1/4. Further, the second scan line driver circuit clock signal (GCK2) is shifted from the first scan line driver circuit clock signal (GCK1) by ¼ of its cycle, the third scan line driver circuit clock signal (GCK3) is shifted from the first scan line driver circuit clock signal (GCK1) by ½ of its cycle, and the fourth scan line driver circuit clock signal (GCK4) is shifted from the first scan line driver circuit clock signal (GCK1) by ¾ of its cycle. The first pulse width control signal (PWC1) periodically repeats the high-level potential (high power supply potential (Vdd)) and the low-level potential (low power supply potential (Vss)), and has a duty ratio of 1/3. In addition, the second pulse width control signal (PWC2) is shifted from the first pulse width control signal (PWC1) by ⅙ of its cycle, the third pulse width control signal (PWC3) is shifted from the first pulse width control signal (PWC1) by ⅓ of its cycle, the fourth pulse width control signal (PWC4) is shifted from the first pulse width control signal (PWC1) by ½ of its cycle, the fifth pulse width control signal (PWC5) is shifted from the first pulse width control signal (PWC1) by ⅔ of its cycle, and the sixth pulse width control signal (PWC6) is shifted from the first pulse width control signal (PWC1) by ⅚ of its cycle. Note that here, the ratio of the pulse width of each of the first to fourth scan line driver circuit clock signals (GCK1 to GCK4) to the pulse width of each of the first to sixth pulse width control signals (PWC1 to PWC6) is 3:2.

In the above-described liquid crystal display device, circuits with the same configuration can be used as the first to m-th pulse output circuits 20_1 to 20_*m*. Note that electrical connection relations of a plurality of terminals included in the pulse output circuit differ depending on the pulse output circuits. Specific connection relation will be described with reference to FIGS. 2A and 2C.

Each of the first to m-th pulse output circuits 20_1 to 20_*m* has terminals 21 to 27. The terminals 21 to 24 and the terminal 26 are input terminals. The terminals 25 and 27 are output terminals.

First, the terminal 21 is described. The terminal 21 in the first pulse output circuit 20_1 is electrically connected to a wiring that supplies the scan line driver circuit start signal (GSP). The terminal 21 in each of the second to m-th pulse output circuits 20_2 to 20_*m* is electrically connected to the terminal 27 in the previous-stage pulse output circuit.

Next, the terminal 22 is described. The terminal 22 in the (4a−3)th pulse output circuit (a is a natural number that is m/4 or less) is electrically connected to the wiring that supplies the first scan line driver circuit clock signal (GCK1). The terminal 22 in the (4a−2)th pulse output circuit is electrically connected to the wiring that supplies the second scan line driver circuit clock signal (GCK2). The terminal 22 in the (4a−1)th pulse output circuit is electrically connected to the wiring that supplies the third scan line driver circuit clock signal (GCK3). The terminal 22 in the 4a-th pulse output circuit is electrically connected to the wiring that supplies the fourth scan line driver circuit clock signal (GCK4).

Then, the terminal 23 is described. The terminal 23 in the (4a−3)th pulse output circuit is electrically connected to the wiring that supplies the second scan line driver circuit clock signal (GCK2). The terminal 23 in the (4a−2)th pulse output circuit is electrically connected to the wiring that supplies the third scan line driver circuit clock signal (GCK3). The terminal 23 in the (4a−1)th pulse output circuit is electrically connected to the wiring that supplies the fourth scan line driver circuit clock signal (GCK4). The terminal 23 in the 4a-th pulse output circuit is electrically connected to the wiring that supplies the first scan line driver circuit clock signal (GCK1).

Next, the terminal 24 is described. The terminal 24 in the (2b−1)th pulse output circuit (b is a natural number that is k/2 or less) is electrically connected to the wiring that supplies the first pulse width control signal (PWC1). The terminal 24 in the 2b-th pulse output circuit is electrically connected to the wiring that supplies the fourth pulse width control signal (PWC4). The terminal 24 in the (2c−1) pulse output circuit (c is a natural number that is (k/2+1) or more and k or less) is electrically connected to the wiring that supplies the second pulse width control signal (PWC2). The terminal 24 in the 2c-th pulse output circuit is electrically connected to the wiring that supplies the fifth pulse width control signal (PWC5). The terminal 24 in the (2d−1)th pulse output circuit (d is a natural number that is (k+1) or more and m/2 or less) is electrically connected to the wiring that supplies the third pulse width control signal (PWC3). The terminal 24 in the 2d-th pulse output circuit is electrically connected to the wiring that supplies the sixth pulse width control signal (PWC6).

Then, the terminal 25 is described. The terminal 25 in the x-th pulse output circuit (x is a natural number that is m or less) is electrically connected to the scan line 13_*x* in the x-th row.

Next, the terminal 26 is described. The terminal 26 in the y-th pulse output circuit (y is a natural number that is (m−1) or less) is electrically connected to the terminal 27 in the (y+1)th pulse output circuit. The terminal 26 in the m-th pulse output circuit is electrically connected to a wiring that supplies an m-th pulse output circuit stop signal (STP). If a (m+1)th pulse output circuit is provided, the m-th pulse output circuit stop signal (STP) corresponds to a signal output from the terminal 27 in the (m+1)th pulse output circuit. Specifically, these signals can be supplied to the m-th pulse output circuit by providing the (m+1)th pulse output circuit as a dummy circuit or by directly inputting these signals from the outside.

The connection relation of the terminal 27 in each of the pulse output circuits has been described above. Therefore, the above description is to be referred to.

<Configuration Example of Pulse Output Circuit>

Figure 2C:
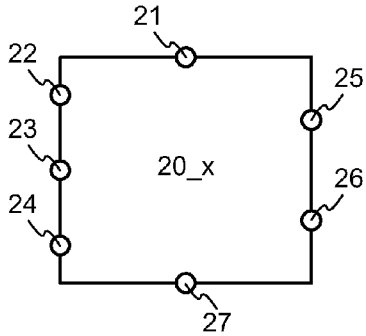
FIG. 2C illustrates a configuration example of a pulse output circuit.
Figure 3A:
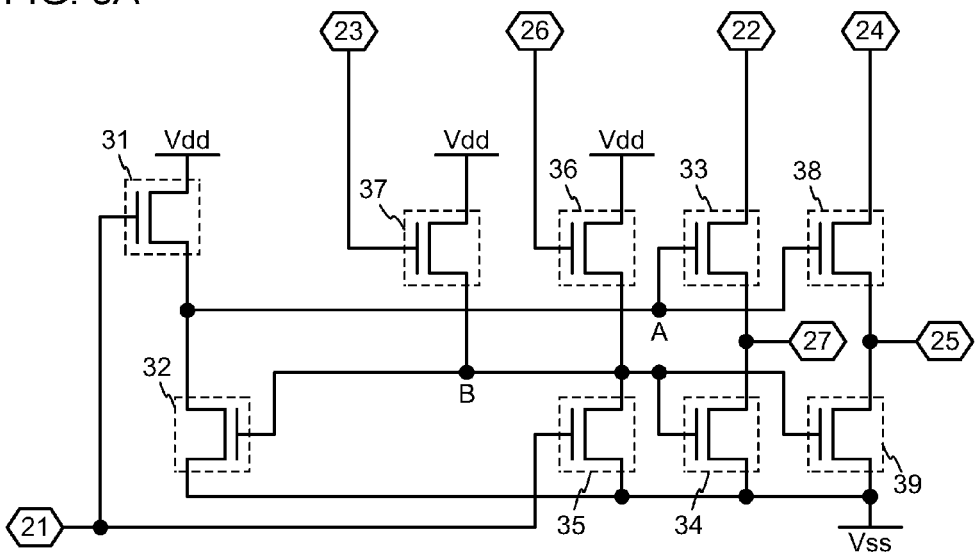
FIG. 3A is a circuit diagram illustrating an example of a pulse output circuit.

FIG. 3A illustrates a configuration example of the pulse output circuit illustrated in FIGS. 2A and 2C. The pulse output circuit in FIG. 3A includes transistors 31 to 39.

One of a source and a drain of the transistor 31 is electrically connected to a wiring that supplies the high power supply potential (Vdd) (hereinafter also referred to as a high power supply potential line). A gate of the transistor 31 is electrically connected to the terminal 21.

One of a source and a drain of the transistor 32 is electrically connected to a wiring that supplies the low power supply potential (Vss) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22. The other of the source and the drain of the transistor 33 is electrically connected to the terminal 27. A gate of the transistor 33 is electrically connected to the other of the source and the drain of the transistor 31 and the other of the source and the drain of the transistor 32.

One of a source and a drain of the transistor 34 is electrically connected to the low power supply potential line. The other of the source and the drain of the transistor 34 is electrically connected to the terminal 27. A gate of the transistor 34 is electrically connected to a gate of the transistor 32.

One of a source and a drain of the transistor 35 is electrically connected to the low power supply potential line. The other of the source and the drain of the transistor 35 is electrically connected to the gate of the transistor 32 and the gate of the transistor 34. A gate of the transistor 35 is electrically connected to the terminal 21.

One of a source and a drain of the transistor 36 is electrically connected to the high power supply potential line. The other of the source and the drain of the transistor 36 is electrically connected to the gate of the transistor 32, the gate of the transistor 34, and the other of the source and the drain of the transistor 35. A gate of the transistor 36 is electrically connected to the terminal 26. Note that it is possible to employ a structure in which one of the source and the drain of the transistor 36 is electrically connected to a wiring that supplies a power supply potential (Vcc) which is higher than the low power supply potential (Vss) and lower than the high power supply potential (Vdd).

One of a source and a drain of the transistor 37 is electrically connected to the high power supply potential line. The other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23. Note that it is possible to employ a structure in which one of the source and the drain of the transistor 37 is electrically connected to a wiring that supplies the power supply potential (Vcc).

One of a source and a drain of the transistor 38 is electrically connected to the terminal 24. The other of the source and the drain of the transistor 38 is electrically connected to the terminal 25. A gate of the transistor 38 is electrically connected to the other of source and the drain of the transistor 31, the other of the source and the drain of the transistor 32, and the gate of transistor 33.

One of a source and a drain of the transistor 39 is electrically connected to the low power supply potential line. The other of the source and the drain of the transistor 39 is electrically connected to the terminal 25. A gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

Note that in the following description, a node where the other of the source and the drain of the transistor 31, the other of the source and the drain of the transistor 32, the gate of the transistor 33, and the gate of the transistor 38 are electrically connected to each other is referred to as a node A. Note also that a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

Figure 3B:
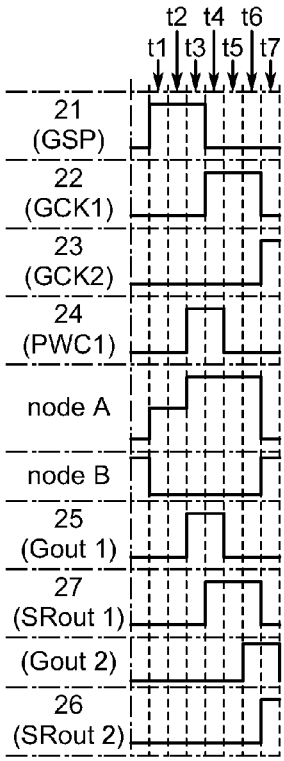
FIGS. 3B to 3D are timing diagrams each illustrating an example of operation of a pulse output circuit.
Figure 3C:
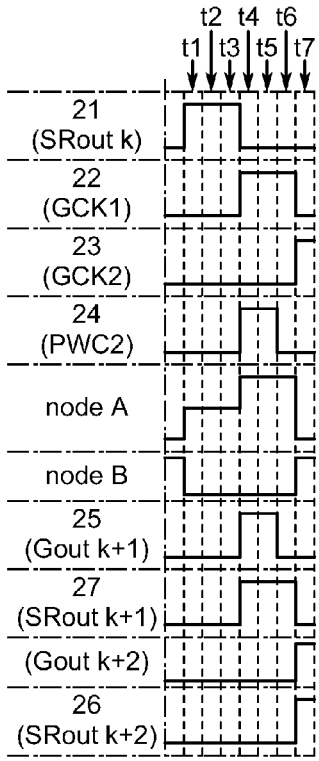
Figure 3D:
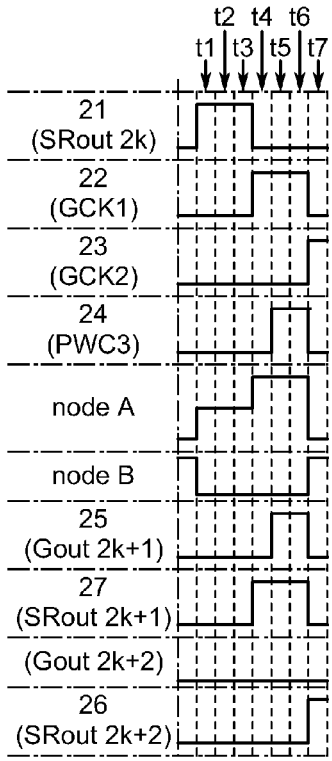

An operation example of the above-described pulse output circuit will be described with reference to FIGS. 3B to 3D. Note that here, the following case will be described: an operation example of when the input timing of the scan line driver circuit start pulse is controlled, shift pulses are output at the same time from the terminals 27 in the first pulse output circuit 20_1, the (k+1)th pulse output circuit 20_(k+1), and the (2k+1)th pulse output circuit 20_(2k+1). The scan line driver circuit start pulse is input to the terminal 21 in the first pulse output circuit 20_1. Specifically, FIG. 3B illustrates potentials of signals input to each terminal in the first pulse output circuit 20_1, potentials of the node A and the node B when the scan line driver circuit start pulse (GSP) is input. FIG. 3C illustrates potentials of signals input to each terminal in the (k+1)th pulse output circuit 20_(k+1), the potentials of the node A and the node B when a high-level potential is input from the k-th pulse output circuit 20_*k*. FIG. 3D illustrates potentials of signals input to each terminal in the (2k+1)th pulse output circuit 20_(2k+1), the potentials of the node A and the node B when a high-level potential is input from the 2k-th pulse output circuit 20_2k. Note that in FIGS. 3B to 3D, the signal input to each terminal is shown in parentheses. Further, FIGS. 3B to 3D show signals (Gout 2, Gout (k+2), and Gout (2k+2)) output from the terminals 25 and output signals (SRout 2=n input signal input to the terminal 26 in the first pulse output circuit 20_1, SRout (k+2)=an input signal input to the terminal 26 in the (k+1)th pulse output circuit 20_(k+1), and SRout (2k+2)=an input signal input to the terminal 26 in the (2k+1)th pulse output circuit 20_(2k+1)) of the terminals 27 in the pulse output circuits (the second pulse output circuit 202, the (k+2)th pulse output circuit 20_(k+2), and the (2k+2)th pulse output circuit 20_(2k+2)) provided in subsequent stages. Note that in FIGS. 3B to 3D, Gout represents an output signal from the pulse output circuit to a scan line, and SRout represents an output signal from the pulse output circuit to the subsequent-stage pulse output circuit.

First, the case where the scan line driver circuit start pulse is input to the first pulse output circuit 20_1 is described with reference to FIG. 3B.

In a period t1, the high-level potential (high power supply potential (Vdd)) is input to the terminal 21. Thus, the transistors 31 and 35 are turned on. As a result, the potential of the node A is increased to a high-level potential (potential that is decreased from the high power supply potential (Vdd) by the threshold voltage of the transistor 31), and the potential of the node B is decreased to the low power supply potential (Vss). The transistors 33 and 38 are turned on and the transistors 32, 34, and 39 are turned off accordingly. Thus, in the period t1, a signal output from the terminal 27 is a signal input to the terminal 22, and a signal output from the terminal 25 is a signal input to the terminal 24. Here, in the period t1, both the signal input to the terminal 22 and the signal input to the terminal 24 have the low-level potentials (low power supply potentials (Vss)). Therefore, in the period t1, the first pulse output circuit 20_1 outputs the low-level potential (low power supply potential (Vss)) to the terminal 21 in the second pulse output circuit 20_2 and the scan line provided in the first row in the pixel portion.

In a period t2, signals input to the terminals each remain unchanged from those in the period t1. Therefore, signals output from the terminal 25 and the terminal 27 remain unchanged, and low-level potentials (low power supply potential (Vss)) are output from the terminal 25 and the terminal 27.

In a period t3, the high-level potential (high power supply potential (Vdd)) is input to the terminal 24. Note that the potential of the node A (potential of the source of the transistor 31) is increased to a high-level potential (potential which is decreased from the high power supply potential (Vdd)) by the threshold voltage of the transistor 31) in the period t1. Therefore, the transistor 31 is off. As this time, the high-level potential (high power supply potential (Vdd)) is input to the terminal 24, whereby the potential of the node A (potential of the gate of the transistor 38) is further increased by capacitive coupling of the source and the gate of the transistor 38 (bootstrap operation). In addition, the bootstrap operation is performed, whereby the signal output from the terminal 25 is not decreased from the high-level potential (high power supply potential (Vdd)) input to the terminal 24. Therefore, in the period t3, the first pulse output circuit 20_1 outputs the high-level potential (high power supply potential (Vdd)=selection signal) to the scan line provided in the first row in the pixel portion.

In a period t4, the high-level potential (high power supply potential (Vdd)) is input to the terminal 22. Here, the potential of the node A is increased due to the bootstrap operation; therefore, a signal output from the terminal 27 is not decreased from the high-level potential (high power supply potential (Vdd)) to be input to the terminal 22. Therefore, in the period t4, the high-level potential (high power supply potential (Vdd)) to be input to the terminal 22 is output from the terminal 27. In other words, the first pulse output circuit 20_1 outputs the high-level potential (high power supply potential (Vdd)=shift pulse) to the terminal 21 in the second pulse output circuit 20_2. In the period t4, a signal input to the terminal 24 maintains the high-level potential (high power supply potential (Vdd)); therefore, a signal which is output from the first pulse output circuit 20_1 to the scan line provided in the first row in the pixel portion remains the high-level potential (high power supply potential (Vdd)=selection signal). Note that although not directly concerned with output signals of the pulse output circuit in the period t4, the transistor 35 is turned off because the low power supply potential (Vss) is input to the terminal 21.

In a period t5, the low-level potential (low power supply potential (Vss)) is input to the terminal 24. Here, the transistor 38 remains on. Therefore, in the period t5, a signal output from the first pulse output circuit 20_1 to the scan line provided in the first row in the pixel portion is the low-level potential (low power supply potential (Vss)).

In a period t6, signals input to the terminals each remain unchanged from those in the period t5. Therefore, signals output from the terminal 25 and the terminal 27 remain unchanged, and the low-level potential (low power supply potential (Vss)) is output from the terminal 25, and the high-level potential (high power supply potential (Vdd)=shift pulse) is output from the terminal 27.

In a period t7, the high-level potential (high power supply potential (Vdd)) is input to the terminal 23. Thus, the transistor 37 is turned on. As a result, the potential of the node B is increased to a high-level potential (potential that is decreased from the high power supply potential (Vdd) by the threshold voltage of the transistor 37). In other words, the transistors 32, 34, and 39 are turned on. The potential of the node A is decreased to the low-level potential (low power supply potential (Vss)) accordingly. In other words, the transistors 33 and 38 are turned off. Thus, in the period t7, signals output from the terminal 25 and the terminal 27 each have the low power supply potential (Vss). In other words, in the period t7, the first pulse output circuit 20_1 outputs a low power supply potential (Vss) to the terminal 21 in the second pulse output circuit 20_2 and the scan line provided in the first row in the pixel portion.

Next, the case where a shift pulse is input from the k-th pulse output circuit 20_*k* to the terminal 21 in the (k+1)th pulse output circuit 20_(k+1) is described with reference to FIG. 3C.

In the period t1 and the period t2, the operation of the (k+1)th pulse output circuit 20_(k+1) is performed in a manner similar to that of the first pulse output circuit 20_1. Therefore, the above description is to be referred to.

In the period t3, signals input to the terminals each remain unchanged from those in the period t2. Therefore, signals output from the terminal 25 and the terminal 27 remain unchanged, and the low-level potentials (low power supply potential (Vss)) are output from the terminal 25 and the terminal 27.

In the period t4, the high-level potential (high power supply potential (Vdd)) is input to the terminal 22 and the terminal 24. Note that the potential of the node A (potential of the source of the transistor 31) is increased to a high-level potential (potential which is decreased from the high power supply potential (Vdd) by the threshold voltage of the transistor 31) in the period t1. Therefore, the transistor 31 is off in the period t1. At this time, by inputting the high-level potential (high power supply potential (Vdd)) to the terminal 22 and the terminal 24, the potential of the node A (the potential of the gate of the transistor 33 and the gate of the transistor 38) is further increased by capacitive coupling between the source and the gate of the transistor 33 and the source and the gate of the transistor 38 (bootstrap operation). In addition, the bootstrap operation is performed, whereby signals output from the terminal 25 and the terminal 27 are not decreased from the high-level potential (high power supply potential (Vdd)) input to the terminal 22 and the terminal 24. Thus, in the period t4, the (k+1)th pulse output circuit 20_(k+1) outputs the high-level potential (high power supply potential (Vdd) =selection signal, shift pulse) to the scan line provided in the (k+1)th line in the pixel portion and the terminal 21 in the (k+2)th pulse output circuit 20_(k+2).

In the period t5, signals input to the terminals each remain unchanged from those in the period t4. Therefore, signals output from the terminal 25 and the terminal 27 remain unchanged, and the high-level potentials (high power supply potential (Vdd)=selection signal, shift pulse) are output from the terminal 25 and the terminal 27.

In the period t6, the low-level potential (low power supply potential (Vss)) is input to the terminal 24. Here, the transistor 38 remains on. Therefore, in the period t6, a signal output from the (k+1)th pulse output circuit 20_(k+1) to the scan line provided in the (k+1)th row in the pixel portion is the low-level potential (low power supply potential (Vss)).

In the period t7, the high-level potential (high power supply potential (Vdd)) is input to the terminal 23. Thus, the transistor 37 is turned on. As a result, the potential of the node B is increased to a high-level potential (potential that is decreased from the high power supply potential (Vdd) by the threshold voltage of the transistor 37). In other words, the transistors 32, 34, and 39 are turned on. The potential of the node A is decreased to the low-level potential (low power supply potential (Vss)) accordingly. In other words, the transistors 33 and 38 are turned off. Thus, in the period t7, signals output from the terminal 25 and the terminal 27 each have the low power supply potential (Vss). In other words, in the period t7, the (k+1)th pulse output circuit 20_(k+1) outputs the low power supply potential (Vss) to the terminal 21 in the (k+2)th pulse output circuit 20_(k+2) and the scan line provided in the (k+1)th row in the pixel portion.

Next, the case where a shift pulse is input from the 2k-th pulse output circuit 20__2k to the terminal 21 in the (2k+1)th pulse output circuit 20_(2k+1) is described with reference to FIG. 3D.

In the periods t1 to t3, the operation of the (2k+1)th pulse output circuit 20_(2k+1) is performed in a manner similar to that of the (k+1)th pulse output circuit 20_(k+1). Therefore, the above description is to be referred to.

In the period t4, the high-level potential (high power supply potential (Vdd)) is input to the terminal 22. Note that the potential of the node A (potential of the source of the transistor 31) is increased to the high-level potential (potential which is decreased from the high power supply potential (Vdd)) by the threshold voltage of the transistor 31) in the period t1. Therefore, the transistor 31 is off in the period t1. At this time, by inputting the high-level potential (high power supply potential (Vdd)) to the terminal 22, the potential of the node A (the potential of the gate of the transistor 33) is further increased by capacitive coupling between the source and the gate of the transistor 33 (bootstrap operation). In addition, the bootstrap operation is performed, whereby a signal output from the terminal 27 is not decreased from the high-level potential (high power supply potential (Vdd)) input to the terminal 22. Thus, in the period t4, the (2k+1)th pulse output circuit 20_(2k+1) outputs the high-level potential (high power supply potential (Vdd)=shift pulse) to the terminal 21 in the (2k+2)th pulse output circuit 20_(2k+2). Note that although not directly concerned with output signals of the pulse output circuit in the period t4, the transistor 35 is turned off because the low-level potential (low power supply potential (Vss)) is input to the terminal 21.

In the period t5, the high-level potential (high power supply potential (Vdd)) is input to the terminal 24. Here, the potential of the node A is increased due to the bootstrap operation; therefore, a signal output from the terminal 25 is not decreased from the high-level potential (high power supply potential (Vdd)) to be input to the terminal 24. Therefore, in the period t5, the high-level potential (high power supply potential (Vdd)) to be input to the terminal 22 is output from the terminal 25. In other words, the (2k+1)th pulse output circuit 20_(2k+1) outputs the high-level potential (high power supply potential (Vdd)=selection signal) to the scan line provided in the (2k+1)th row in the pixel portion. In the period t5, a signal input to the terminal 22 maintains the high-level potential (high power supply potential (Vdd)); therefore, a signal which is output from the (2k+1)th pulse output circuit 20_(2k+1) to the terminal 21 in the (2k+2)th pulse output circuit 20_(2k+2) remains the high-level potential (high power supply potential (Vdd)=selection signal).

In the period t6, signals input to the terminals each remain unchanged from those in the period t5. Therefore, signals output from the terminal 25 and the terminal 27 remain unchanged, and the high-level potentials (high power supply potential (Vdd)=selection signal, shift pulse)) are output from the terminal 25 and the terminal 27.

In the period t7, the high-level potential (high power supply potential (Vdd)) is input to the terminal 23. Thus, the transistor 37 is turned on. As a result, the potential of the node B is increased to a high-level potential (potential that is decreased from the high power supply potential (Vdd) by the threshold voltage of the transistor 37). In other words, the transistors 32, 34, and 39 are turned on. The potential of the node A is decreased to the low-level potential (low power supply potential (Vss)) accordingly. In other words, the transistors 33 and 38 are turned off. Thus, in the period t7, signals output from the terminal 25 and the terminal 27 each have the low power supply potential (Vss). In other words, in the period t7, the (2k+1)th pulse output circuit 20_(2k+1) outputs the low power supply potential (Vss) to the terminal 21 in the (2k+2) th pulse output circuit 20_(2k+2) and the scan line provided in the (2k+1)th row in the pixel portion.

As illustrated in FIGS. 3B to 3D, the input timing of the scan line driver circuit start pulse (GSP) is controlled in the first to m-th pulse output circuits 20_1 to 20_*m*, whereby a plurality of shift pulses can be shifted concurrently. Specifically, after the scan line driver circuit start pulse (GSP) is input, another scan line driver circuit start pulse (GSP) is input at the same timing as the output of a shift pulse from the terminal 27 in the k-th pulse output circuit 20_*k*, whereby a shift pulse can be output at the same timing from the first pulse output circuit 20_1 and (k+1)th pulse output circuit 20_(k+1). Similarly, the scan line driver circuit start pulse (GSP) is input, whereby a shift pulse can be output from the first pulse output circuit 20_1, the (k+1)th pulse output circuit 20_(k+1), and the (2k+1)th pulse output circuit 20_(2k+1) at the same timing.

In addition to the above-described operation, the first pulse output circuit 20_1, the (k+1)th pulse output circuit 20_(k+1), and the (2k+1)th pulse output circuit 20_(2k+1) can supply selection signals to the scan lines at different timings. In other words, the above-described scan line driver circuit can shift a plurality of shift pulses including a specific shift period, and a plurality of pulse output circuits to which shift pulses are input at the same timing can supply selection signals to the scan lines at different timings.

<Configuration Example of Signal Line Driver Circuit 12>

Figure 4A:
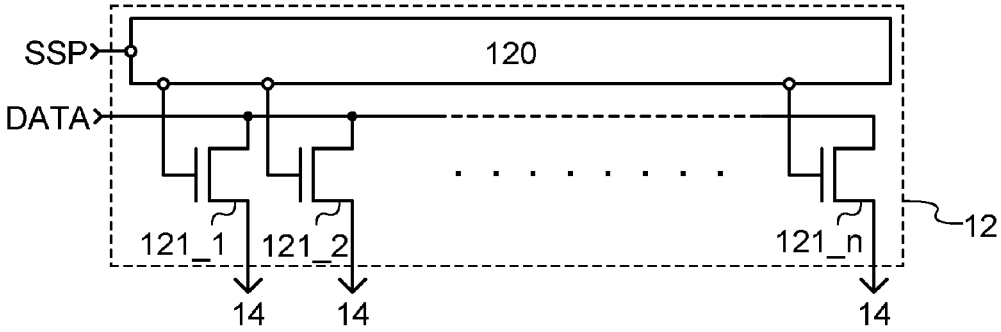
FIG. 4A illustrates a configuration example of a signal line driver circuit.

FIG. 4A illustrates a configuration example of the signal line driver circuit 12 included in the liquid crystal display device illustrated in FIG. 1A. The signal line driver circuit 12 illustrated in FIG. 4A includes a shift register 120 having first to n-th output terminals, a wiring which supplies an image signal (DATA), and transistors 121_1 to 121_*n*. One of a source and a drain of the transistor 121_1 is electrically connected to the wiring which supplies an image signal (DATA), the other of the source and the drain of the transistor 121_1 is electrically connected to a signal line provided in a first row in a pixel portion, and a gate of the transistor 121_1 is electrically connected to the first output terminal of the shift register 120. One of a source and a drain of the transistor 121_*n* is electrically connected to the wiring which supplies an image signal (DATA), the other of the source and the drain of the transistor 121_*n* is electrically connected to a signal line provided in an n-th row in the pixel portion, and a gate of the transistor 121_*n* is electrically connected to the n-th output terminal of the shift register 120. Note that the shift register 120 has a function of sequentially outputting a high-level potential from the first to n-th output terminals in each shift period by using a signal line driver circuit start pulse (SSP) as a trigger. In other words, the transistors 121_1 to 121_*n* are sequentially turned on for each shift period.

Figure 4B:
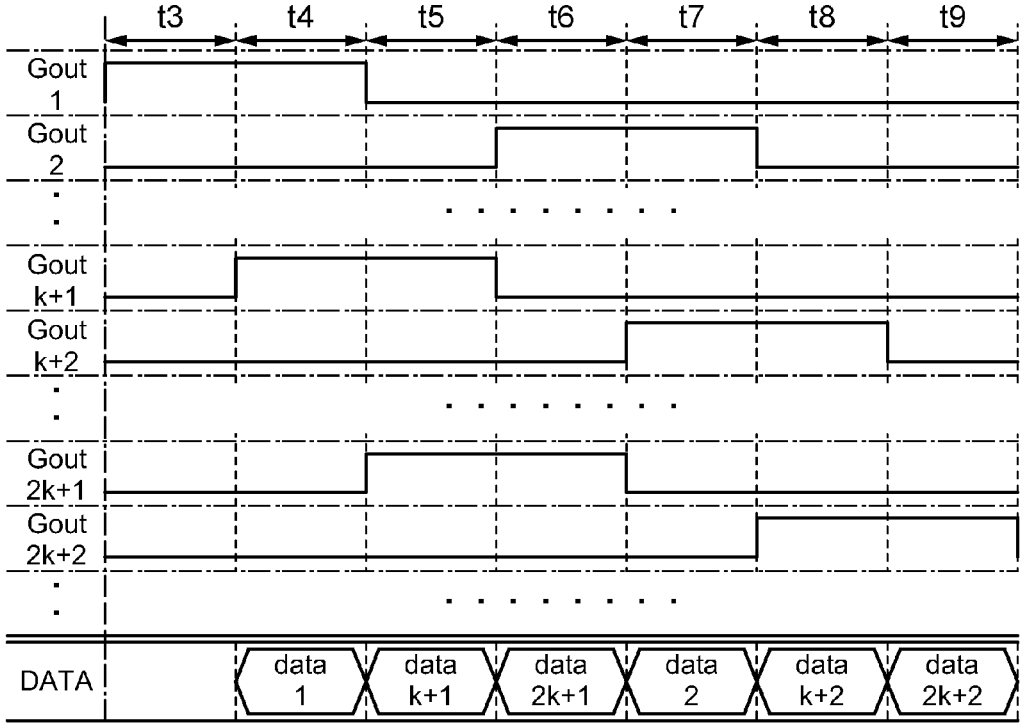
FIG. 4B illustrates an example of operation of the signal line driver circuit.

FIG. 4B illustrates an example of a timing of an image signal supplied by the wiring which supplies an image signal (DATA). As illustrated in FIG. 4B, the wiring which supplies an image signal (DATA) supplies an image signal (data 1) for a pixel provided in the first row in the period t4, an image signal (data (k+1)) for a pixel provided in the (k+1)th row in the period t5, an image signal (data (2k+1)) for a pixel provided in the (2k+1)th row in the period t6, and an image signal (data 2) for a pixel provided in the second row in the period t7. Similarly, the wiring which supplies an image signal (DATA) sequentially supplies an image signal for a pixel provided in each given row. Specifically, an image signal is supplied in the following order: an image signal for a pixel provided in the s-th row (s is a natural number that is less than k), an image signal for a pixel provided in the (k+s)th row, an image signal for a pixel provided in the (2k+s)th row, and an image signal for a pixel provided in the (s+1)th row. The above-described scan line driver circuit and the above-described signal line driver circuit perform the operation, whereby writing of an image signal to pixels of three rows provided in the pixel portion in the pulse output circuit included in the scan line driver circuit in each shift period can be performed.

<Configuration Example of Backlight>

Figure 5:
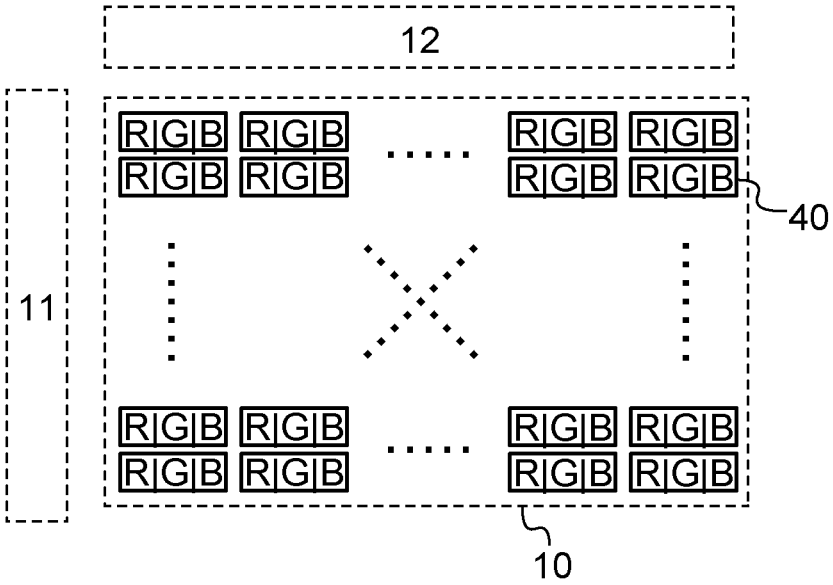
FIG. 5 illustrates a configuration example of a backlight.

FIG. 5 illustrates a configuration example of a backlight provided behind the pixel portion 10 in the liquid crystal display device illustrated in FIG. 1A. The backlight illustrated in FIG. 5 includes a plurality of backlight units 40 each including light sources each emitting one of red (R) light, green (G) light, and blue (B) light. Note that the plurality of backlight units 40 is arranged in a matrix and lighting of the backlight units 40 can be controlled every given region. Here, the backlight unit 40 is provided at least every t rows and n columns (here, t is k/4) as the backlight for the plurality of pixels 15 provided in the m rows and the n columns. Lighting of the backlight units 40 can be controlled independently. In other words, the backlight can include at least a backlight unit for the first to t-th rows to a backlight unit for (2k+3t+1)th to m-th rows. Lighting of the backlight units 40 can be controlled independently. In the backlight unit 40, the light sources emitting red (R) light, green (G) light, and blue (B)

light emit light at the same time (three colors of light are mixed: red (R), green (G), and blue (B)), whereby white (W) light can be emitted.

<Operation Example of Liquid Crystal Display Device>

Figure 6:
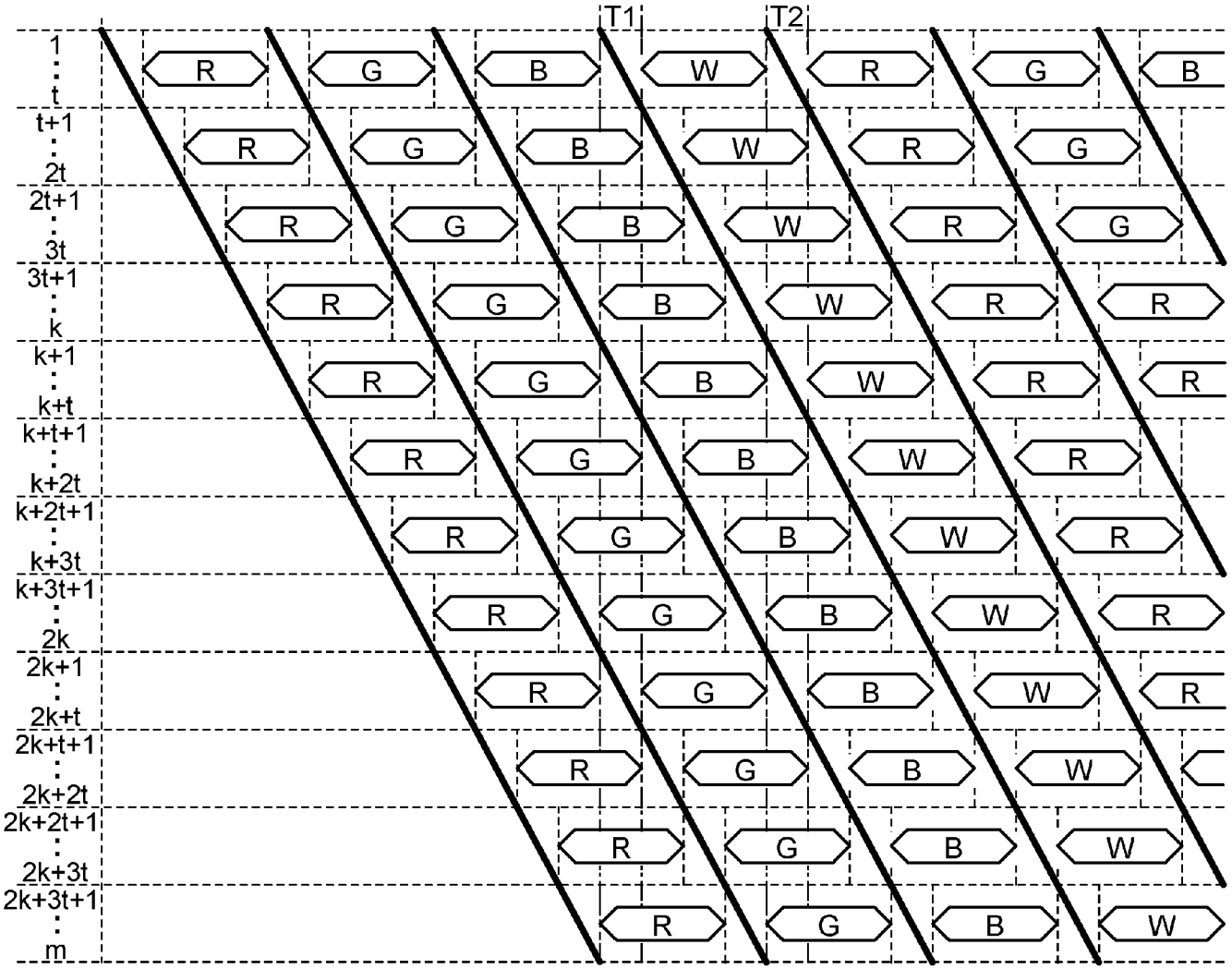
FIG. 6 illustrates an operation example of a liquid crystal display device.

FIG. 6 illustrates a scan of the selection signal and timing of turning on the backlight in the above-described liquid crystal display device. Note that in FIG. 6, the vertical axis represents rows in the pixel portion, and the horizontal axis represents time. Specifically, 1 to m indicate the number of rows and solid lines indicate timing of when image signals are input in the rows in FIG. 6. In the liquid crystal display device as illustrated in FIG. 6, selection signals are not sequentially supplied to the scan lines provided in the first to m-th rows, but the selection signals can be sequentially supplied to the scan lines with an interval of k rows in the following order: the scan line provided in the first row; the scan line provided in the (k+1)th row; the scan line provided in the (2k+1)th row; and the scan line provided in the second row. Therefore, in a period T1, the n pixels provided in the first row to the n pixels provided in the t-th row are sequentially selected; the n pixels provided in the (k+1)th row to the n pixels provided in the (k+t)th row are sequentially selected; and the n pixels provided in the (2k+1)th row to the n pixels provided in the (2k+t)th row are sequentially selected, whereby image signals can be input to each pixels. Note that here, an image signal used to control white (W) light transmission is input to the n pixels provided in the first row to the n pixels provided in the t-th row, an image signal used to control blue (B) light transmission is input to the n pixels provided in the (k+1)th row to the n pixels provided in the (k+t)th row, and an image signal used to control green (G) light transmission is input to the n pixels provided in the (2k+1)th row to the n pixels provided in the (2k+t)th row.

In the liquid crystal display device as illustrated in FIG. 6, lighting of the backlight can be performed in a period which is provided between periods in which an image signal is written in a given area. Specifically, in the period between the period T1 and a period T2, the backlight units for the first to t-th rows emit white (W) light (emit all of red (R) light, green (G) light, and blue (B) light), the backlight units for the (k+1)th to (k+t)th rows emit blue (B) light, and the backlight units for the (2k+1)th to (2k+t)th rows emit green (G) light. Note that in the liquid crystal display device illustrated in FIG. 6, an image is formed in the pixel portion by the operation from writing of a red (R) image signal to lighting of white (W) backlight.

<Liquid Crystal Display Device Disclosed in this Embodiment>

The liquid crystal display device according to this embodiment can write an image signal and can display images by a field sequential method, concurrently. Accordingly, the frequency of input of an image signal to each pixel of the liquid crystal display device can be increased. As a result, color break generated in the field-sequential liquid crystal display device can be suppressed, and the quality of an image displayed by the liquid crystal display device can be improved.

The liquid crystal display device disclosed in this embodiment can achieve the above-described operation with a simple pixel configuration. Specifically, a pixel of a liquid crystal display device disclosed in Patent Document 1 needs a transistor which controls transfer of an electrical charge in addition to the configuration of the pixel of the liquid crystal display device disclosed in this embodiment. Further, the pixel of the liquid crystal display device disclosed in Patent Document 1 needs another signal line for controlling switching of the transistor. In contrast, the pixel configuration of the liquid crystal display device of this embodiment is simple. In other words, the aperture ratio of the pixel in the liquid crystal display device of this embodiment can be increased as compared to the liquid crystal display device disclosed in Patent Document 1. Further, the liquid crystal display device of this embodiment can reduce parasitic capacitance generated between various wirings by decreasing the number of wirings extended to the pixel portion. In other words, it is possible to perform high-speed operation of various wirings extended to the pixel portion.

In the case where a backlight in the liquid crystal display device disclosed in this embodiment emits light as illustrated in FIG. 6, the adjacent backlight units do not emit lights of different colors. Specifically, in the case where the backlight emits light after an image signal is written in a region in the period T1, the adjacent backlight units do not emit lights of different colors. For example, in the period T1, when the backlight unit for the (k+1)th to (k+t)th rows emits blue (B) light after the blue (B) image signals are input to the n pixels provided in the (k+1)th row to the n pixels provided in the (k+t)th row, blue (B) light is emitted or emission itself is not performed (neither red (R) light nor green (G) light is emitted) for a backlight unit in the (3t+1)th to k-th rows and a backlight unit for the (k+t+1)th to (k+2t)th rows. Thus, the probability of transmission of light of a color different from a given color through a pixel to which image data on the given color is input can be reduced.

Modification Example

The liquid crystal display device described in this embodiment is one embodiment of the present invention, and the present invention includes a liquid crystal display device which is different from the liquid crystal display device.

For example, in the liquid crystal display device of this embodiment, the pixel portion 10 is divided into three regions and image signals are supplied in parallel to the three regions; however, the liquid crystal display device of the present invention is not limited to the structure. In other words, the liquid crystal display device of the present invention can have a structure in which the pixel portion 10 is divided into a plurality of regions other than three and image signals are supplied in parallel to the plurality of regions. Note that in the case where the number of the regions is changed, it is necessary to set a scan line driver circuit clock signal and a pulse width control signal in accordance with the number of the regions.

In the liquid crystal display device of this embodiment, light sources each emitting one of red (R) light, green (G) light, and blue (B) light are used for the backlight; however, the liquid crystal display device of the present invention is not limited to having this structure. In other words, in the liquid crystal display device of the present invention, light sources that emit lights of given colors can be used in combination. For example, it is possible to use a combination of four kinds of light sources of red (R), green (G), blue (B), and white (W); a combination of four kinds of light sources of red (R), green (G), blue (B), and yellow (Y); or a combination of three kinds of light sources of cyan (C), magenta (M), and yellow (Y). Note that in the case where the backlight unit includes a light source which emits white (W) light, white (W) light is emitted not by color mixture but by using the light source. The light source has high emission efficiency; therefore, the backlight is formed using the light source, whereby power consumption can be reduced. In the case where the backlight unit includes two colors which are complementary colors to each other (for example, in the case where two colors of blue (B) and yellow (Y) are included), the two colors are mixed, whereby white (W) light can be emitted. Further, light sources that emit lights of six colors of pale red (R), pale green (G), pale blue (B), deep red (R), deep green (G), and deep blue (B) can be used in combination or light sources that emit lights of six colors of red (R), green (G), blue (B), cyan (C), magenta (M), and yellow (Y) can be used in combination. In such a manner, with a combination of light sources of a wider variety of colors, the color gamut of the liquid crystal display device can be enlarged, and the image quality can be improved.

The liquid crystal display device of this embodiment includes the capacitor for holding voltage applied to the liquid crystal element (see FIG. 1B); alternatively, it is possible to employ a structure in which the capacitor is not provided. In this case, the aperture ratio of the pixel can be increased. The capacitance wiring extended to the pixel portion can be removed; therefore, it is possible to perform high-speed operation of various wirings extended to the pixel portion.

Figure 7A:
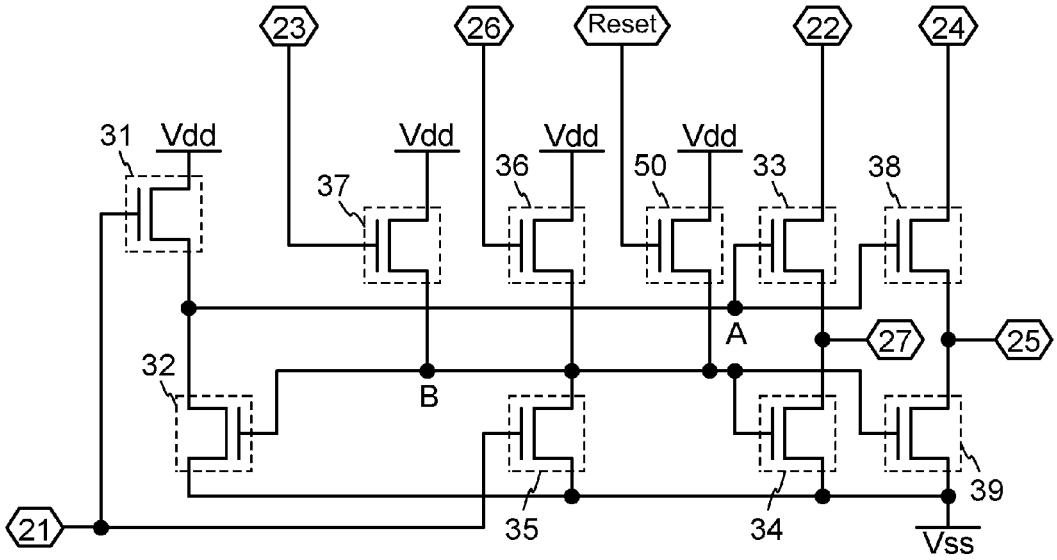
FIGS. 7A and 7B are circuit diagrams each illustrating an example of a pulse output circuit.

For example, the pulse output circuit can have a structure where a transistor 50 is additionally provided in the pulse output circuit illustrated in FIG. 3A (see FIG. 7A). One of a source and a drain of the transistor 50 is electrically connected to the high power supply potential line. The other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39. A gate of the transistor 50 is electrically connected to a reset terminal (Reset). Note that a high-level potential is input to the reset terminal in a period after writing of a red (R) image signal to lighting of the white (W) backlight are performed in the pixel portion, while a low-level potential is input in the other period. Note that the transistor 50 is turned on when a high-level potential is input. Thus, the potential of each node can be initialized in the period after the backlight is turned on, so that malfunction can be prevented. Note that in the case where the initialization is performed, it is necessary to provide an initialization period between periods in each of which an image is formed in the pixel portion. In the case where a period in which the backlight is turned off is provided after the period in which an image is formed in the pixel portion, which will be described later with reference to FIG. 9, it is possible to perform the initialization in the period in which the backlight is turned off.

Figure 7B:
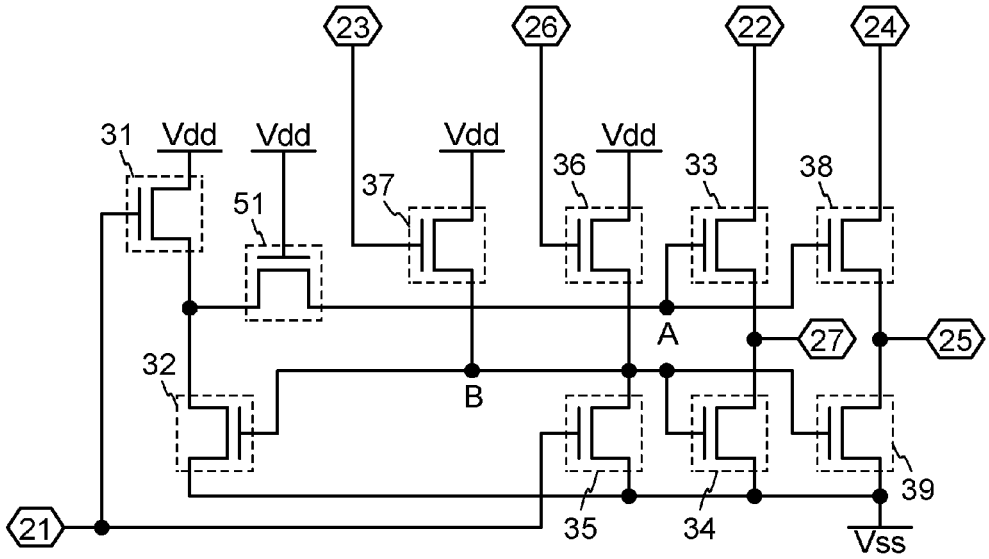

The pulse output circuit can have a structure where a transistor 51 is added to the pulse output circuit illustrated in FIG. 3A (see FIG. 7B). One of a source and a drain of the transistor 51 is electrically connected to the other of the source and the drain of the transistor 31 and the other of the source and the drain of the transistor 32. The other of the source and the drain of the transistor 51 is electrically connected to the gate of the transistor 33 and the gate of the transistor 38. A gate of the transistor 51 is electrically connected to the high power supply potential line. Note that the transistor 51 becomes an off state in a period in which the potential of the node A is a high-level potential (the periods t1 to t6 illustrated in FIGS. 3B to 3D). Therefore, with a structure to which the transistor 51 is added, in the periods t1 to t6, an electrical connection between the gate of the transistor 33 and the gate of the transistor 38, and the other of the source and the drain of the transistor 31 and the other of the source and the drain of the transistor 32 can be broken. Accordingly, in the period of the periods t1 to t6, a load in the bootstrap operation in the pulse output circuit can be reduced.

Figure 8A:
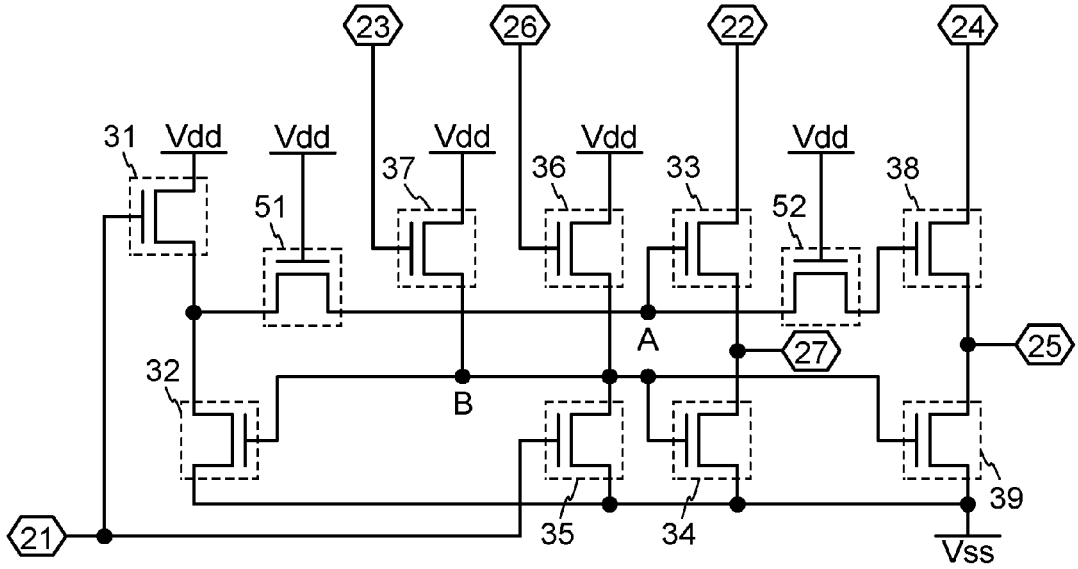
FIGS. 8A and 8B are circuit diagrams each illustrating an example of a pulse output circuit.

The pulse output circuit can have a structure where a transistor 52 is added to the pulse output circuit illustrated in FIG. 7B (see FIG. 8A). One of a source and a drain of the transistor 52 is electrically connected to the gate of the transistor 33 and the other of the source and the drain of the transistor 51. The other of the source and the drain of the transistor 52 is electrically connected to the gate of the transistor 38. A gate of the transistor 52 is electrically connected to the high power supply potential line. Note that the transistor 52 is provided as described above, whereby a load in the bootstrap operation in the pulse output circuit can be reduced. An effect due to a decrease in loads, in particular, in the case where the potential of the node A in the pulse output circuit is increased only by capacitive coupling between the source and the gate of the transistor 33 (see FIG. 3D), is great.

Figure 8B:
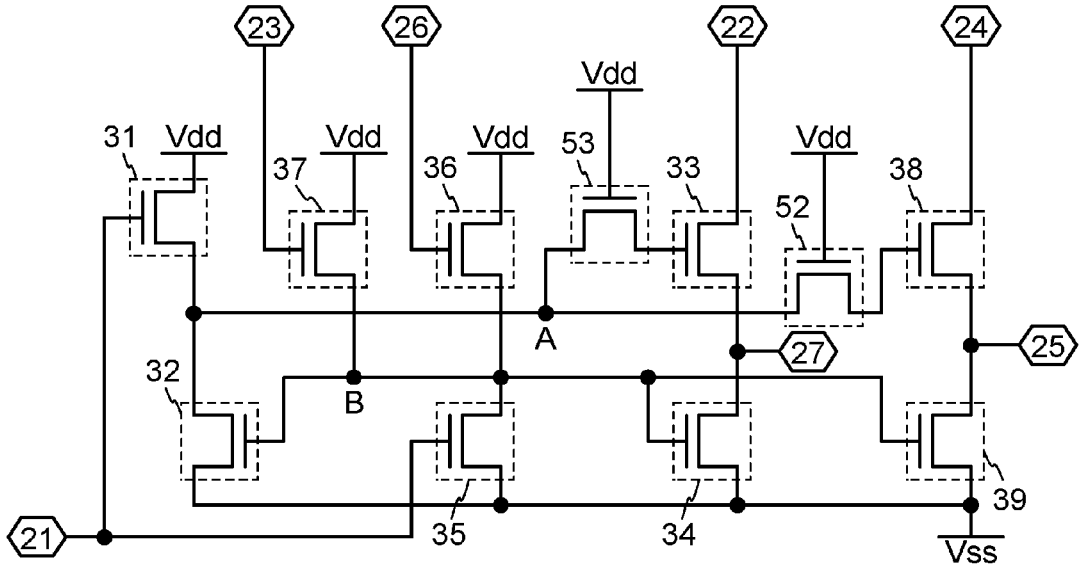

As the pulse output circuit, it is possible to use a structure (see FIG. 8B) in which the transistor 51 is removed from the pulse output circuit illustrated in FIG. 8A and a transistor 53 is added; one of a source and a drain of the transistor 53 is electrically connected to the other of the source and the drain of the transistor 31, the other of the source and the drain of the transistor 32, and one of the source and the drain of the transistor 52; the other of the source and the drain of the transistor 53 is electrically connected to the gate of the transistor 33; and a gate of the transistor 53 is electrically connected to the high power supply potential line. When the transistor 53 is provided as described above, a load in the bootstrap operation in the pulse output circuit can be reduced. An adverse effect of an irregular pulse generated in the pulse output circuit on the switching of the transistors 33 and 38 can be reduced.

Furthermore, the liquid crystal display device of this embodiment has a structure where light sources each emitting one of red (R) light, green (G) light, and blue (B) light are arranged linearly and horizontally as a backlight unit (see FIG. 5); however, the structure of the backlight unit is not limited to such a structure. For example, three kinds of light sources may be arranged in triangle or aligned linearly and vertically, or a red (R) backlight unit, a green (G) backlight unit, and a blue (B) backlight unit may be separately provided. Moreover, the liquid crystal display device includes a direct-lit backlight as the backlight (see FIG. 5); however, an edge-lit backlight can be used as the backlight.

In the liquid crystal display device of this embodiment, the red (R) backlight, the green (G) backlight, the blue (B) backlight, and the white (W) backlight emit light sequentially in each given region of the pixel portion, whereby an image is formed; however, the lighting order of the backlights is not limited to the structure. For example, lighting is performed in the order of blue (B), green (G), red (R), and white (W) or the order of green (G), white (W), red (R), and blue (B), whereby an image can be formed. A given color can be emitted plural times. For example, lighting is performed in the order of blue (B) light, red (R) light, green (G) light, blue (B) light, and white (W) light so that the light source emits blue (B) light with low spectral luminous efficacy twice, whereby an image can be formed. Note that it is needless to say that the input order of a given-color image signal is needed to be designed as appropriate in accordance with the lighting order of the backlights.

Figure 9:
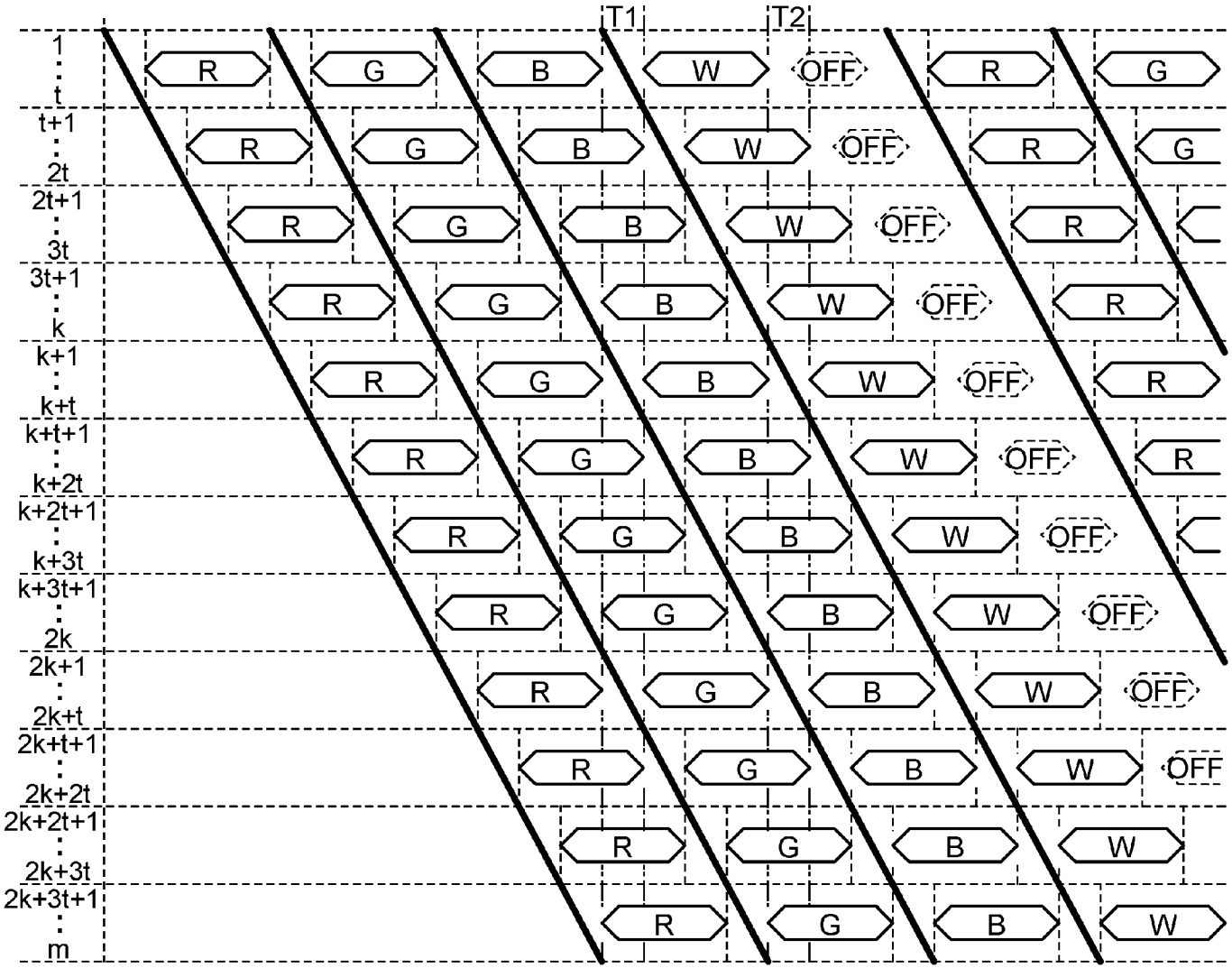
FIG. 9 illustrates an operation example of a liquid crystal display device.

In the liquid crystal display device of this embodiment, a structure is illustrated in which the scan of the selection signal and the lighting of the backlight unit are successively performed (see FIG. 6); however, the operation of the liquid crystal display device is not limited to the structure. For example, before and after the period in which an image is formed in the pixel portion (the period is from the period in which a red (R) image signal is input, to the period in which the backlight emits white (W) light in FIG. 6), it is possible to provide a period in which the scan of the selection signal and the lighting of the backlight unit are not performed (see FIG. 9). Therefore, color break generated in the liquid crystal display device can be suppressed, and the quality of an image displayed by the liquid crystal display device can be improved. Note that FIG. 9 illustrates a structure in which the scan of the selection signal and the lighting of the backlight unit are not performed; however, it is possible to perform the scan of the selection signal and to input an image signal used for not transmitting light to each pixel.

Note that it is possible to use a plurality of structures described as modification examples of this embodiment for the liquid crystal display device of this embodiment.

This embodiment or part of this embodiment can be freely combined with the other embodiments or part of the other embodiments.

Embodiment 2

In this embodiment, a liquid crystal display device of one embodiment of the present invention having a structure which is different from that in Embodiment 1 will be described with reference to FIGS. 10A to 10D, FIGS. 11A and 11B, FIGS. 12A and 12B, and FIG. 13.

<Configuration Example of Liquid Crystal Display Device>

Figure 10A:
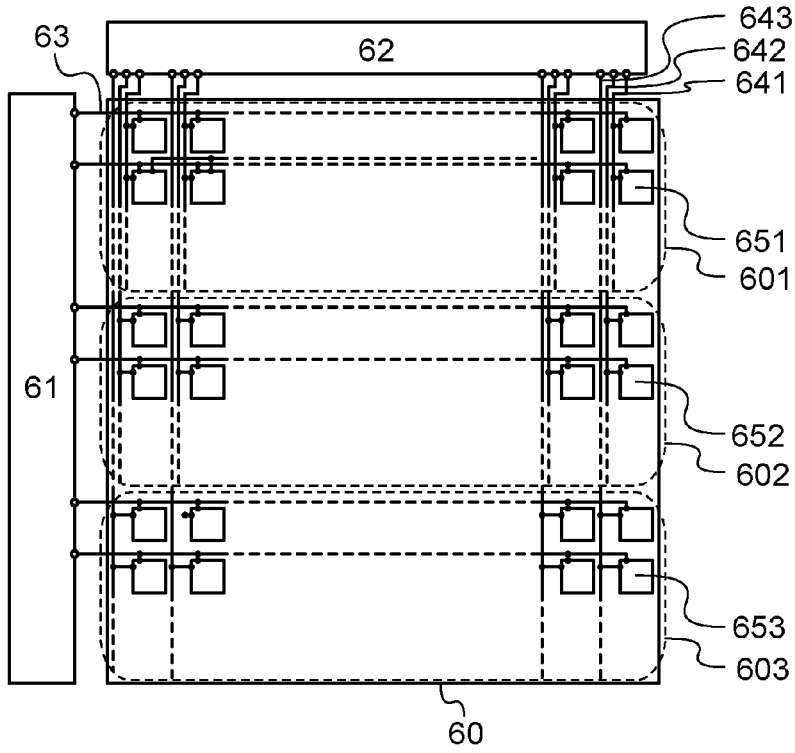
FIG. 10A illustrates a configuration example of a liquid crystal display device.

FIG. 10A illustrates a configuration example of a liquid crystal display device. The liquid crystal display device in FIG. 10A includes a pixel portion 60; a scan line driver circuit 61; a signal line driver circuit 62; 3i (i is a natural number that is 2 or more) scan lines 63, arranged parallel or approximately parallel to each other; and j (j is a natural number that is 2 or more) signal lines 641, j signal lines 642, and j signal lines 643 arranged parallel or approximately parallel to each other. The potentials of the scan lines 63 are controlled by the scan line driver circuit 61. The potentials of the signal lines 641, 642, and 643 are controlled by the signal line driver circuit 62.

The pixel portion 60 is divided into three regions (regions 601 to 603), and each region includes a plurality of pixels arranged in a matrix (i rows and j columns). Each of the scan lines 63 is electrically connected to j pixels provided in a given row among the plurality of pixels arranged in a matrix (3i rows and j columns) in the pixel portion 60. Each of the signal lines 641 is electrically connected to i pixels provided in a given column among the plurality of pixels arranged in a matrix (i rows and j columns) in the region 601. Further, each of the signal lines 642 is electrically connected to i pixels provided in a given column among the plurality of pixels arranged in a matrix (i rows and j columns) in the region 602. Each of the signal lines 643 is electrically connected to i pixels provided in a given column among the plurality of pixels arranged in a matrix (i rows and j columns) in the region 603.

Note that the scan line driver circuit start signal (GSP), the scan line driver circuit clock signal (GCK), and drive power supply potentials such as a high power supply potential and a low power supply potential are input to the scan line driver circuit 61 from the outside. Further, signals such as the signal line driver circuit start pulse (SSP), a signal line driver circuit clock signal (SCK), and image signals (data1 to data3), and drive power supply potentials such as a high power supply potential and a low power supply potential are input to the signal line driver circuit 62 from the outside.

Figure 10B:
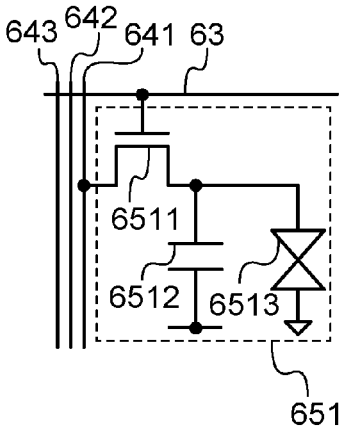
FIGS. 10B to 10D illustrate configuration examples of pixels.
Figure 10C:
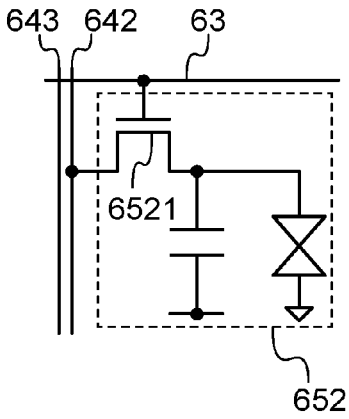
Figure 10D:
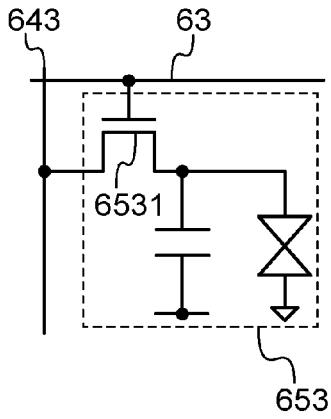

FIGS. 10B to 10D each illustrate an example of a circuit configuration of a pixel. Specifically, FIG. 10B illustrates an example of a circuit configuration of a pixel 651 provided in the region 601. FIG. 10C illustrates an example of a circuit configuration of a pixel 652 provided in the region 602. FIG. 10D illustrates an example of a circuit configuration of a pixel 653 provided in the region 603. The pixel 651 in FIG. 10B includes a transistor 6511, a capacitor 6512, and a liquid crystal element 6513. A gate of the transistor 6511 is electrically connected to the scan line 63, and one of a source and a drain of the transistor 6511 is electrically connected to the signal line 641. One electrode of the capacitor 6512 is electrically connected to the other of the source and the drain of the transistor 6511, and the other electrode of the capacitor 6512 is electrically connected to a wiring (also referred to as a capacitor wiring) which supplies a capacitor potential. One electrode (also referred to as a pixel electrode) of the liquid crystal element 6513 is electrically connected to the other of the source and the drain of the transistor 6511 and one electrode of the capacitor 6512, and the other electrode (also referred to as a counter electrode) of the liquid crystal element 6513 is electrically connected to a wiring which supplies a counter potential.

The circuit configurations of the pixel 652 illustrated in FIG. 10C and the pixel 653 illustrated in FIG. 10D are the same as that of the pixel 651 illustrated in FIG. 10B. Note that the pixel 652 in FIG. 10C differs from the pixel 651 in FIG. 10B in that one of a source and a drain of a transistor 6521 is electrically connected to the signal line 642 instead of the signal line 641. The pixel 653 in FIG. 10D differs from the pixel 651 in FIG. 10B in that one of a source and a drain of a transistor 6531 is electrically connected to the signal line 643 instead of the signal line 641.

<Configuration Example of Scan Line Driver Circuit 61>

Figure 11A:
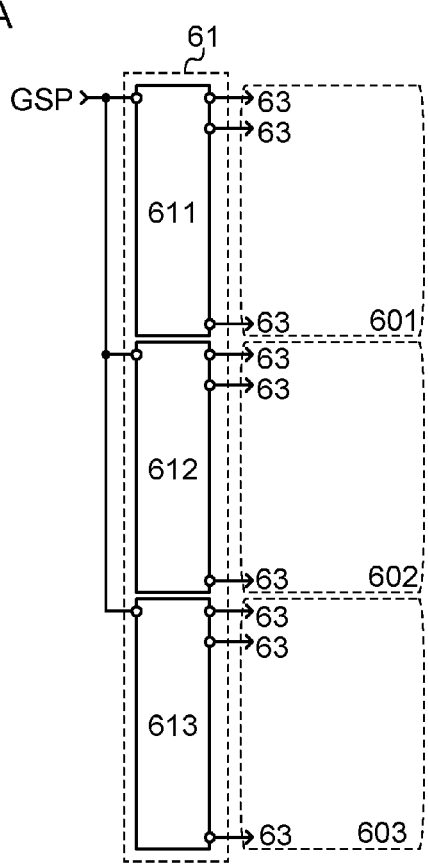
FIG. 11A illustrates a configuration example of a scan line driver circuit.

FIG. 11A illustrates a configuration example of the scan line driver circuit 61 included in the liquid crystal display device illustrated in FIG. 10A. The scan line driver circuit 61 illustrated in FIG. 11A includes shift registers 611 to 613 each including i output terminals. Note that each output terminal of the shift register 611 is electrically connected to one of the i scan lines 63 provided in the region 601. Each output terminal of the shift register 612 is electrically connected to one of the i scan lines 63 provided in the region 602. Each output terminal of the shift register 613 is electrically connected to one of the i scan lines 63 provided in the region 603. In other words, the shift register 611 scans selection signals in the region 601; the shift register 612 scans selection signals in the region 602; and the shift register 613 scans selection signals in the region 603. Specifically, the shift register 611 has a function of sequentially shifting selection signals (sequentially selecting the scan lines 63 every half the cycle of the scan line driver circuit clock signal (GCK)) from the scan line 63 provided in a first row by using the scan line driver circuit start pulse (GSP) that is input from the outside as a trigger; the shift register 612 has a function of sequentially shifting selection signals from the scan line 63 provided in a (i+1)th row by using the scan line driver circuit start signal (GSP) that is input from the outside as a trigger; and the shift register 613 has a function of sequentially shifting selection signals from the scan line 63 provided in a (2i+1)th row by using the scan line driver circuit start signal (GSP) that is input from the outside as a trigger.

Figure 11B:
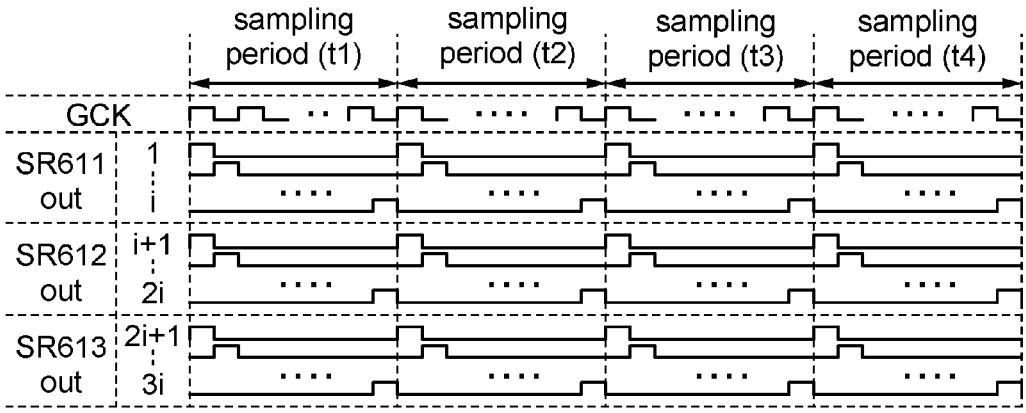
FIG. 11B illustrates output signals of the scan line driver circuit.

An operation example of the scan line driver circuit 61 is described with reference to FIG. 11B. Note that FIG. 11B illustrates the scan line driver circuit clock signal (GCK), signals (SR611 out) output from the i output terminals of the shift register 611, signals (SR612 out) output from the i output terminals of the shift register 612, and signals (SR613 out) output from the i output terminals of the shift register 613.

In a sampling period (t1), the shift register 611 sequentially shifts high-level potentials every half the cycle of the clock signal (horizontal scan period) from the scan line 63 provided in the first row served as a trigger to the scan line 63 provided in an i-th row; the shift register 612 sequentially shifts high-level potentials every half the cycle of the clock signal (horizontal scan period) from the scan line 63 provided in the (i+1)th row served as a trigger to the scan line 63 provided in a 2i-th row; and the shift register 613 sequentially shifts high-level potentials every half the cycle of the clock signal (horizontal scan period) from the scan line 63 provided in the (2i+1)th row served as a trigger to the scan line 63 provided in a 3i-th row. Therefore, in the scan line driver circuit 61, j pixels 651 provided in the first row to j pixels 651 provided in the i-th row are sequentially selected through the scan lines 63; j pixels 652 provided in the (i+1)th row to j pixels 652 provided in the 2i-th row are sequentially selected; and j pixels 653 provided in the (2i+1)th row to j pixels 653 provided in the 3i-th row are sequentially selected. In other words, the scan line driver circuit 61 can supply selection signals to 3j pixels provided in three different rows every horizontal scan period.

In sampling periods (t2) to (t4), the operation of the shift registers 611 to 613 is the same as that in the sampling period (t1). In other words, in the scan line driver circuit 61, as in the sampling period (t1), selection signals can be supplied to 3j pixels provided in given three rows every horizontal scan period.

<Configuration Example of Signal Line Driver Circuit 62>

Figure 12A:
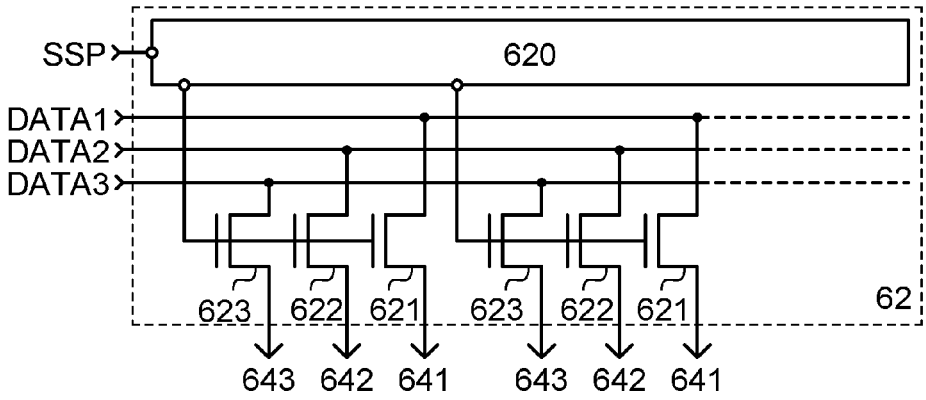
FIG. 12A illustrates a configuration example of a signal line driver circuit.

FIG. 12A illustrates a configuration example of the signal line driver circuit 62 included in the liquid crystal display device illustrated in FIG. 10A. The signal line driver circuit 62 illustrated in FIG. 12A includes a shift register 620 having j output terminals, j transistors 621, j transistors 622, and j transistors 623. Note that a gate of the transistor 621 is electrically connected to a p-th output terminal (p is a natural number that is 1 or more and j or less) of the shift register 620; one of a source and a drain of the transistor 621 is electrically connected to a wiring for supplying a first image signal (DATA1); and the other of the source and the drain of the transistor 621 is electrically connected to the signal line 641 provided in a p-th column in the pixel portion 60. A gate of the transistor 622 is electrically connected to the p-th output terminal of the shift register 620; one of a source and a drain of the transistor 622 is electrically connected to a wiring for supplying a second image signal (DATA2); and the other of the source and the drain of the transistor 622 is electrically connected to the signal line 642 in the p-th column in the pixel portion 60. Further, a gate of the transistor 623 is electrically connected to the p-th output terminal of the shift register 620; one of a source and a drain of the transistor 623 is electrically connected to a wiring for supplying a third image signal (DATA3); and the other of the source and the drain of the transistor 623 is electrically connected to the signal line 643 provided in the p-th column in the pixel portion 60.

Figure 12B:
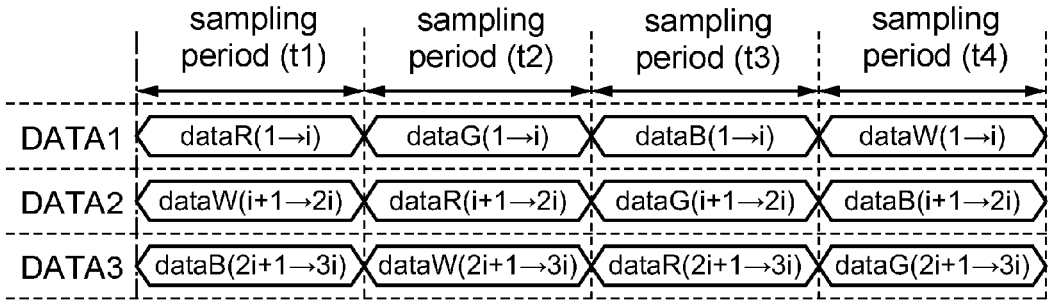
FIG. 12B illustrates an example of operation of the signal line driver circuit.

FIG. 12B illustrates an example of a timing of an image signal supplied by a wiring which supplies the first to third image signals (DATA1 to DATA3). As illustrated in FIG. 12B, the wiring which supplies the first image signal (DATA1) supplies red (R) image signals (dataR(1→i)) for pixels provided in the first to i-th rows in the sampling period (t1); green (G) image signals (dataG(1→i)) for pixels provided in the first to i-th rows in the sampling period (t2); blue (B) image signals (dataB(1→i)) for pixels provided in the first to i-th rows in the sampling period (t3); and white (W) image signals (dataW(1→i)) for pixels provided in the first to i-th rows in the sampling period (t4). The wiring which supplies the second image signal (DATA2) supplies white (W) image signals (dataW(i+1→2i) for pixels provided in the (i+1)th to 2i-th rows in the sampling period (t1); red (R) image signals (dataR (i+1→2i)) for pixels provided in the (i+1)th to 2i-th rows in the sampling period (t2); green (G) image signals (dataG(i+1→2i)) for pixels provided in the (i+1)th to 2i-th rows in the sampling period (t3); and blue (B) image signals (dataB(i+1→2i) for pixels provided in the (i+1)th to 2i-th rows in the sampling period (t4). The wiring which supplies the third image signal (DATA3) supplies blue (B) image signals (dataB (2i+1→3i) for pixels provided in the (2i+1)th to 3i-th rows in the sampling period (t1); white (W) image signals (dataW (2i+1→3i)) for pixels provided in the (2i+1)th to 3i-th rows in the sampling period (t2); red (R) image signals (dataR(2i+1→3i) for pixels provided in the (2i+1)th to 3i-th rows in the sampling period (t3); and green (G) image signals (dataG(2i+1→3i) for pixels provided in the (2i+1)th to 3i-th rows in the sampling period (t4).

<Configuration Example of Backlight>

A backlight similar to the backlight described in Embodiment 1 (see FIG. 5) can be used as a backlight of the liquid crystal display device described in this embodiment. Here, as the backlight of this embodiment for the plurality of pixels of 3i rows and j columns, a backlight unit is provided at least every h rows and j columns (here, h is i/4), and it is possible to achieve independent control of lighting of these backlight units. In other words, the backlight can include at least a backlight unit for the first to h-th rows to a backlight unit for (2i+3h+1)th to 3i-th rows. Lighting of the backlight units can be controlled independently.

<Operation Example of Liquid Crystal Display Device>

Figure 13:
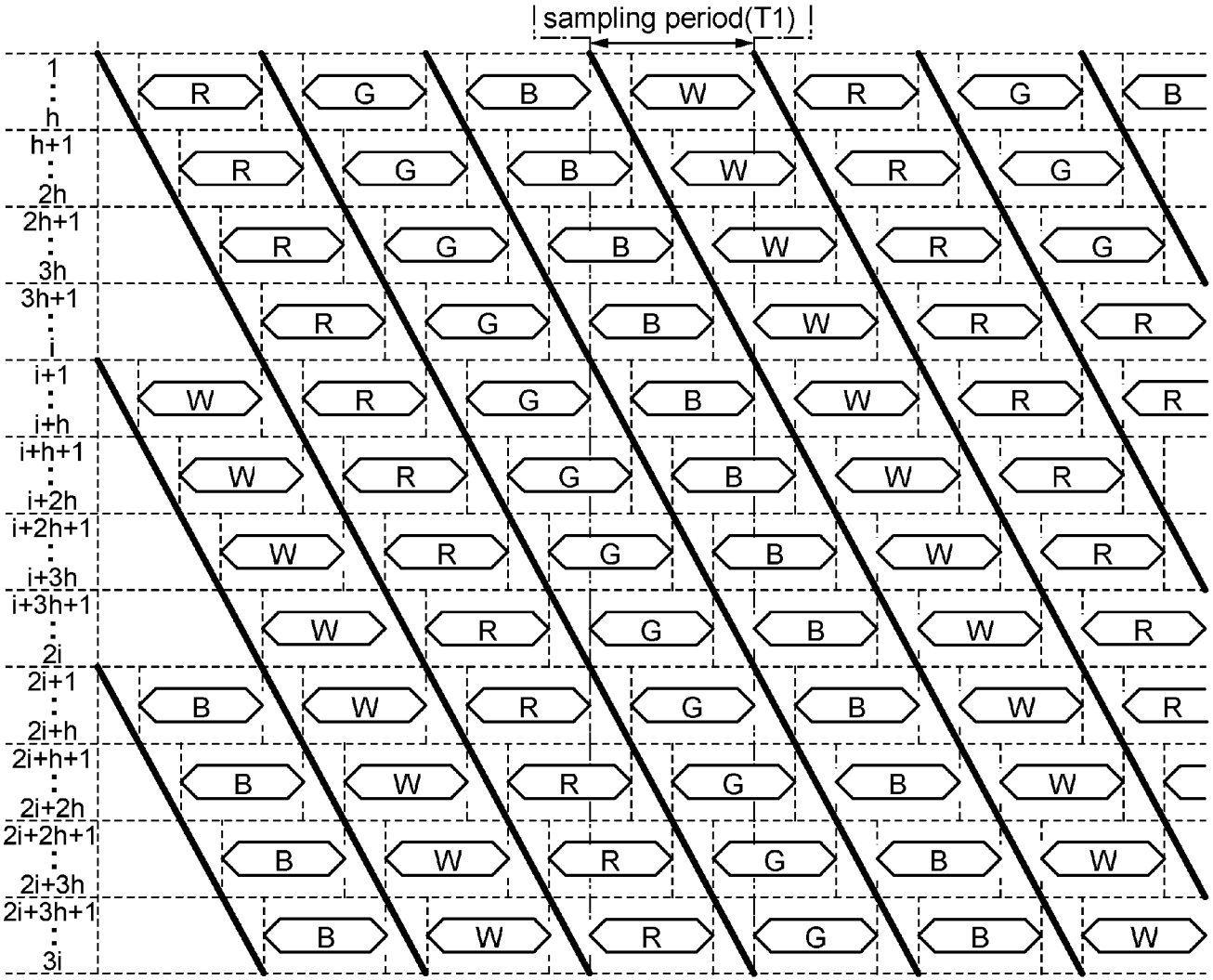
FIG. 13 illustrates an operation example of a liquid crystal display device.

FIG. 13 illustrates a scan of the selection signal and timing of turning on the backlight in the above-described liquid crystal display device. Note that in FIG. 13, the vertical axis represents rows in the pixel portion, and the horizontal axis represents time. Specifically, "1" to "3i" indicate the number of rows and solid lines indicate timing of when image signals are input in the rows in FIG. 13. In the liquid crystal display device, in a sampling period (T1), the j pixels 651 provided in the first row to the j pixels 651 provided in the i-th row are sequentially selected; the j pixels 652 provided in the (i+1)th row to the j pixels 652 provided in the 2i-th row are sequentially selected; and the j pixels 653 provided in the (2i+1)th row to the j pixels 653 provided in the 3i-th row are sequentially selected. Thus, the image signal can be input to each pixel. Specifically, in the liquid crystal display device, in the sampling period (T1), the white (W) image signals can be sequentially input to the pixels through the signal lines 641 when the transistors 6511 included in the j pixels 651 provided in the first row to the transistors 6511 included in the j pixels 651 provided in the i-th row are sequentially turned on through the scan lines 63; the blue (B) image signals can be sequentially input to the pixels through the signal lines 642 when the transistors 6521 included in the j pixels 652 provided in the (i+1)th row to the transistors 6521 included in the j pixels 652 provided in the 2i-th row are sequentially turned on through the scan lines 63; and the green (G) image signals can be sequentially input to the pixels through the signal lines 643 when the transistors 6531 included in the j pixels 653 provided in the (2i+1)th row to the transistors 6531 included in the j pixels 653 provided in the 3i-th row are sequentially turned on through the scan lines 63.

Further, in the liquid crystal display device, in the sampling period (T1), white (W) light can be emitted from the backlight unit for the first to h-th rows after the white (W) image signals are input to the j pixels 651 provided in the first row to the j pixels 651 provided in the h-th row; blue (B) light can be emitted from the backlight unit for the (i+1)th to (i+h)th rows after the blue (B) image signals are input to the j pixels 652 provided in the (i+1)th row to the j pixels 652 provided in the (i+h)th row; and green (G) light can be emitted from the backlight unit for the (2i+1)th to (2i+h)th rows after the green (G) image signals are input to the j pixels 653 provided in the (2i+1)th row to the j pixels 653 provided in the (2i+h)th row. In other words, in the liquid crystal display device, the scan of a selection signal and lighting of the backlight unit which emits a given color can be performed concurrently every given region (the first to i-th rows, the (i+1)th to 2i-th rows, and the (2i+1) to 3i-th rows) in the pixel. Note that in the liquid crystal display device, an image can be formed in the pixel portion in such a way that operation from writing of the red (R) image signals to lighting of the white (W) backlight is performed in the region 601 including the pixels provided in the first to i-th rows, operation from writing of the white (W) image signals to lighting of the blue (B) backlight is performed in the region 602 including the pixels provided in the (i+1)th to 2i-th rows, and operation from writing of the blue (B) image signals to lighting of the green (G) backlight is performed in the region 603 including the pixels provided in the (2i+1)th to 3i-th rows.

<Liquid Crystal Display Device of this Embodiment>

In the liquid crystal display device disclosed in this specification, image signals can be concurrently supplied to pixels provided in a plurality of rows among pixels arranged in a matrix. Thus, the frequency of input of an image signal to each pixel can be increased without change in response speed of a transistor or the like included in the liquid crystal display device. In other words, the liquid crystal display device is preferably applied to a field-sequential liquid crystal display device or a liquid crystal display device driven by high frame rate driving.

The reasons why the liquid crystal display device disclosed in this specification is preferably used as a field-sequential liquid crystal display device are as follows. As described above, in the field-sequential liquid crystal display device, color information is time-divided. Thus, display viewed by a user might be changed (deviated) from display based on original display data (such a phenomenon is also referred to as color break or color breakup) due to lack of given display data that is caused by block of display in a short time (e.g., blink of the user). Here, the increase in the frame frequency is effective in suppressing color break. On the other hand, in order to display images by a field sequential method, it is necessary to input an image signal to each pixel with frequency which is higher than the frame frequency. Therefore, in the case where images are displayed in a conventional liquid crystal display device by a field sequential method and high frame rate driving, extremely high performance (extremely high response speed) of an element included in the liquid crystal display device is needed. In contrast, in the liquid crystal display device disclosed in this specification, the frequency of input of an image signal to each pixel can be increased regardless of characteristics of elements. Thus, color break can be easily suppressed in the field-sequential liquid crystal display device.

Further, in the case where backlight units emit lights as illustrated in FIG. 13, the adjacent backlight units do not emit lights of different colors. Specifically, in the sampling period (T1), when the backlight unit for the (i+1)th to (i+h)th rows emits blue (B) light after the blue (B) image signals are input to the j pixels 652 in the (i+1)th row to the j pixels 652 in the (i+h)th row, blue (B) light is emitted or emission itself is not performed (neither red (R) light nor green (G) light is emitted) for a backlight unit for (3h+1)th to i-th rows and a backlight unit for (i+h+1)th to (i+2h)th rows. Thus, the probability of transmission of light of a color different from a given color through a pixel to which image data on the given color is input can be reduced.

Modification Example

The liquid crystal display device described in this embodiment is one embodiment of the present invention, and the present invention includes a liquid crystal display device which is different from the liquid crystal display device.

For example, the liquid crystal display device described in this embodiment has a structure where the pixel portion 60 is divided into three regions; however, the structure of the liquid crystal display device of the present invention is not limited to such a structure. In other words, in the liquid crystal display device of the present invention, the pixel portion 60 can be divided into given plural regions. Note that it is apparent that in the case where the number of regions is changed, the number of regions and the number of shift registers should be the same.

In the liquid crystal display device of this embodiment, the number of pixels is the same in three regions (i.e., each of the regions includes pixels of i rows and j columns); alternatively, the number of pixels can be changed between regions in the liquid crystal display device of the present invention. Specifically, pixels can be provided in a rows and the j columns (a is a natural number) in a first region, and pixels can be provided in b rows and the j columns (b is a natural number which is different from a) in a second region.

Further, in the liquid crystal display device of this embodiment, the scan line driver circuit includes shift registers; however, the shift registers can be replaced with circuits having similar functions. For example, the shift registers can be replaced with decoders.

In the liquid crystal display device of this embodiment, light sources each emitting one of red (R) light, green (G) light, and blue (B) light are used for the backlight; however, the liquid crystal display device of the present invention is not limited to having this structure. In other words, in the liquid crystal display device of this embodiment, light sources that emit lights of given colors can be used in combination. For example, it is possible to use a combination of four kinds of light sources of red (R), green (G), blue (B), and white (W); a combination of four kinds of light sources of red (R), green (G), blue (B), and yellow (Y); or a combination of three kinds of light sources of cyan (C), magenta (M), and yellow (Y). Note that in the case where the backlight unit includes a light source which emits white (W) light, white (W) light is emitted not by color mixture but by using the light source. The light source has high emission efficiency; therefore, the backlight is formed using the light source, whereby power consumption can be reduced. In the case where the backlight unit includes two colors which are complementary colors to each other (for example, in the case where two colors of blue (B) and yellow (Y) are included), the two colors are mixed, whereby white (W) light can be emitted. Further, light sources that emit lights of six colors of pale red (R), pale green (G), pale blue (B), deep red (R), deep green (G), and deep blue (B) can be used in combination or light sources that emit lights of six colors of red (R), green (G), blue (B), cyan (C), magenta (M), and yellow (Y) can be used in combination. In such a manner, with a combination of light sources of a wider variety of colors, the color gamut of the liquid crystal display device can be enlarged, and the image quality can be improved.

The liquid crystal display device of this embodiment includes the capacitor for holding voltage applied to the liquid crystal element (see FIGS. 10B to 10D); alternatively, it is possible to employ a structure in which the capacitor is not provided. In this case, the aperture ratio of the pixel can be increased. The capacitance wiring extended to the pixel portion can be removed; therefore, it is possible to perform high-speed operation of various wirings extended to the pixel portion.

The liquid crystal display device of this embodiment has a structure in which a variety of light sources included in the backlight sequentially emits light in a given order in each given region of the pixel portion in order to form an image; however, the lighting order is not limited to that of the structure. A light source that emits a given color can be emitted plural times. For example, a light source emits blue (B) light with low spectral luminous efficacy twice in each given region of the pixel portion, whereby an image can be formed. Note that it is needless to say that the input order of a given-color image signal is needed to be designed as appropriate in accordance with the lighting order of the backlights.

Figure 14:
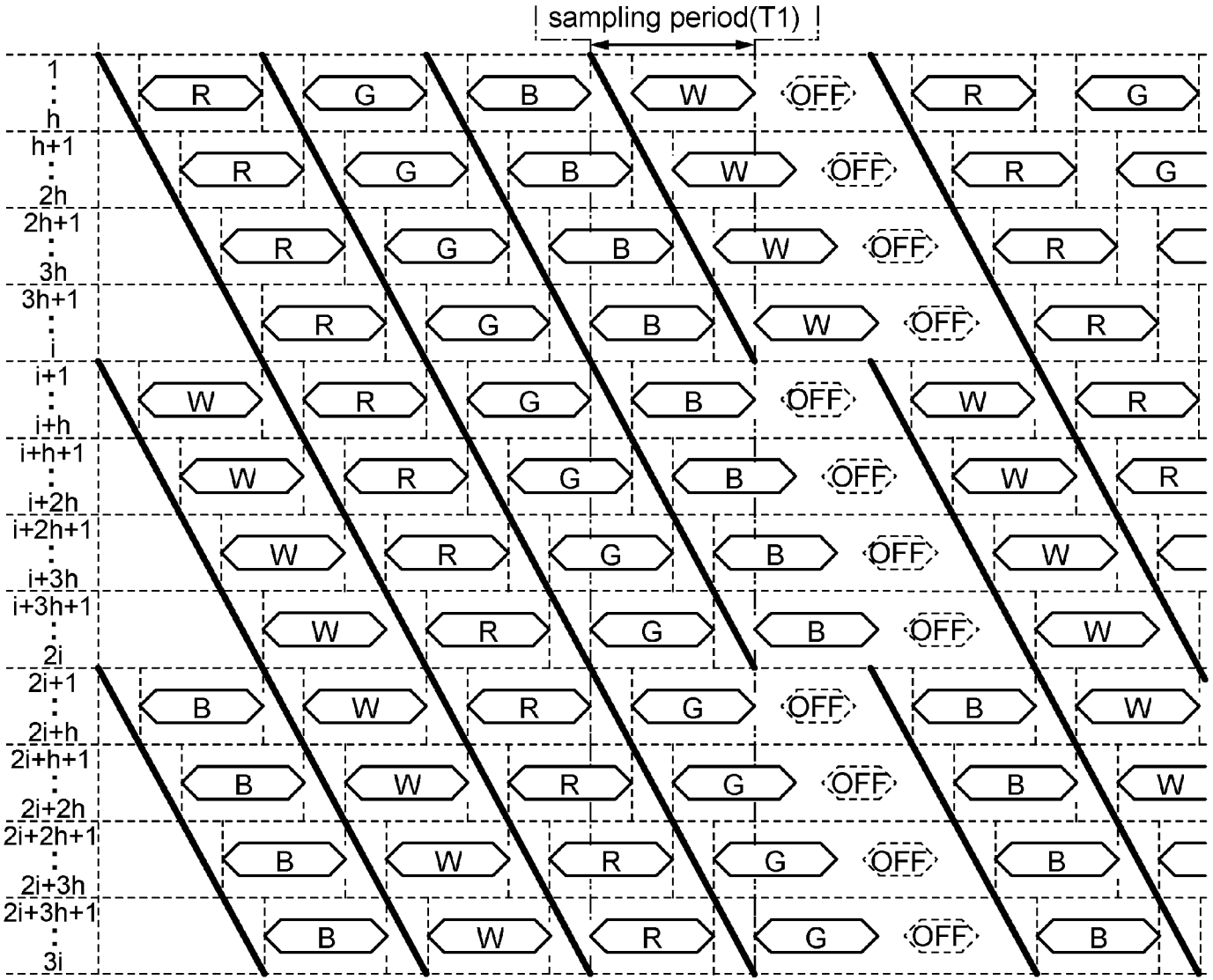
FIG. 14 illustrates an operation example of a liquid crystal display device.

In the liquid crystal display device of this embodiment, a structure is illustrated in which the scan of the selection signal and the lighting of the backlight unit are successively performed (see FIG. 13); however, the operation of the liquid crystal display device is not limited to the structure. For example, before and after the period in which an image is formed in the pixel portion, it is possible to provide a period (non-lighting period) in which the scan of the selection signal and the lighting of the backlight unit are not performed (see FIG. 14). Therefore, color break generated in the liquid crystal display device can be suppressed, and the quality of an image displayed by the liquid crystal display device can be improved. Note that FIG. 14 illustrates a structure in which the scan of the selection signal and the lighting of the backlight unit are not performed; however, it is possible to perform the scan of the selection signal and to input an image signal used for not transmitting light to each pixel.

In the liquid crystal display device of this embodiment, the lighting order of the backlights depend on regions when an image is formed in the whole pixel portion (specifically, the backlight emits red (R) light, green (G) light, blue (B) light, and white (W) light in that order in the region 601 (first to i-th rows); the backlight emits white (W) light, red (R) light, green (G) light, and blue (B) light in that order in the region 602 ((i+1)th to 2i-th rows); and the backlight emits blue (B) light, white (W) light, red (R) light, and green (G) light in that order in the region 603 ((2i+1)th to 3i-th rows), whereby an image is formed in the whole pixel portion). However, the backlight can emit light in the same lighting order in the whole pixel portion as illustrated in FIG. 6 and FIG. 9, whereby an image can be formed. Note that in that case, it is necessary to provide another start pulse for each of the plurality of shift registers in order to shift the timing of operation of the plurality of shift registers included in the scan line driver circuit. In addition, it is necessary to set the order of image signals output from the signal line driver circuit, as appropriate.

Note that it is possible to use a plurality of structures described as modification examples of this embodiment for the liquid crystal display device of this embodiment.

Note that this embodiment or part of this embodiment can be freely combined with the other embodiments or part of the other embodiments.

Embodiment 3

In this embodiment, a structural example of a transistor included in the liquid crystal display device will be described below with reference to FIG. 15. Note that in the liquid crystal display device, transistors provided in a pixel portion, a scan line driver circuit, and a signal line driver circuit may have the same structure or different structures.

Figure 15:
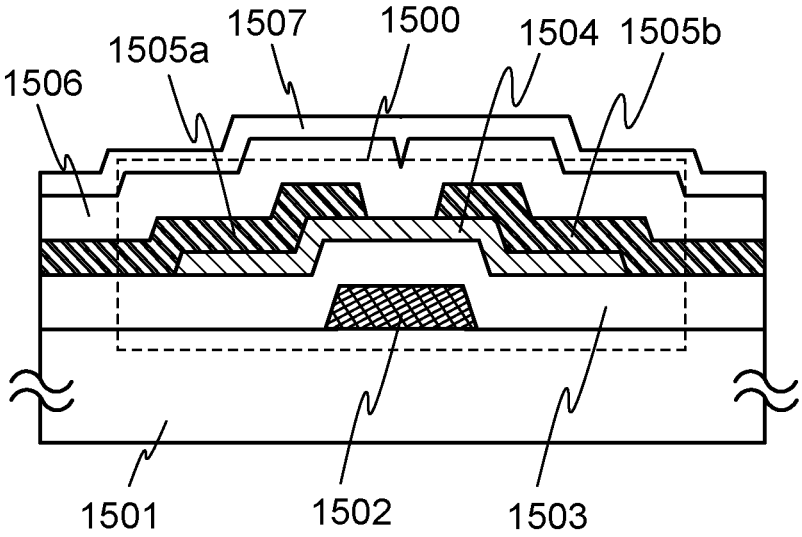
FIG. 15 illustrates a structural example of a transistor.

A transistor 1500 illustrated in FIG. 15 includes a gate layer 1502 provided over a substrate 1501 having an insulating surface, a gate insulating layer 1503 provided over the gate layer 1502, a semiconductor layer 1504 provided over the gate insulating layer 1503, and a source layer 1505*a* and a drain layer 1505*b* which are provided over the semiconductor layer 1504. Further, over the transistor 1500 illustrated in FIG. 15, an insulating layer 1506 which is in contact with the oxide semiconductor layer 1504, and a protective insulating layer 1507 provided over the insulating layer 1506 are formed.

Note that examples of the substrate 1501 include a semiconductor substrate (e.g., a single crystal substrate or a silicon substrate), an SOI substrate, a glass substrate, a quartz substrate, a conductive substrate whose top surface is provided with an insulating layer, flexible substrates such as a plastic substrate, a bonding film, paper containing a fibrous material, and a base film. As an example of a glass substrate, a barium borosilicate glass substrate, an aluminoborosilicate glass substrate, a soda lime glass substrate, and the like can be given. For a flexible substrate, a flexible synthetic resin such as plastics typified by polyethylene terephthalate (PET), polyethylene naphthalate (PEN), and polyether sulfone (PES), or acrylic can be used, for example.

For the gate layer 1502, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

For the gate insulating layer 1503, an insulator such as silicon oxide, silicon nitride, silicon oxynitride, silicon nitride oxide, aluminum oxide, tantalum oxide, or gallium oxide can be used. A layered structure of these materials can also be used. Note that silicon oxynitride refers to a substance which contains more oxygen than nitrogen and contains oxygen, nitrogen, silicon, and hydrogen at given concentrations ranging from 55 atomic % to 65 atomic %, 1 atomic % to 20 atomic %, 25 atomic % to 35 atomic %, and 0.1 atomic % to 10 atomic %, respectively, where the total percentage of atoms is 100 atomic %. Further, the silicon nitride oxide film refers to a film which contains more nitrogen than oxygen and contains oxygen, nitrogen, silicon, and hydrogen at given concentrations ranging from 15 to 30 atomic %, 20 to 35 atomic %, 25 to 35 atomic %, and 15 to 25 atomic %, respectively, where the total percentage of atoms is 100 atomic %.

The semiconductor layer 1504 can be formed using any of the following semiconductor materials, for example: a material containing an element belonging to Group 14 of the periodic table, such as silicon (Si) or germanium (Ge), as its main component; a compound such as silicon germanium (SiGe) or gallium arsenide (GaAs); oxide such as zinc oxide (ZnO) or zinc oxide containing indium (In) and gallium (Ga); or an organic compound exhibiting semiconductor characteristics can be used. A layered structure of layers formed using these semiconductor materials can also be used.

Moreover, in the case where an oxide (an oxide semiconductor) is used for the semiconductor layer 1504, any of the following oxide semiconductors can be used: an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor which are oxides of three metal elements; an In—Ga—O-based oxide, an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are oxides of two metal elements; and an In—O-based oxide semiconductor, a Sn—O-based oxide semiconductor, and a Zn—O-based oxide semiconductor which are oxides of one metal element. Further, $SiO_2$ may be contained in the above oxide semiconductor. Here, for example, the In—Ga—Zn—O-based oxide semiconductor means an oxide containing at least In, Ga, and Zn, and the composition ratio of the elements is not particularly limited. The In—Ga—Zn—O-based oxide semiconductor may contain an element other than In, Ga, and Zn.

As the oxide semiconductor, a thin film represented by the chemical formula, $InMO_3(ZnO)_m$ (m>0) can be used. Here, M represents one or more metal elements selected from Ga, Al, Mn, and Co. For example, M may be Ga, Ga and Al, Ga and Mn, Ga and Co, or the like.

When an In—Zn—O-based material is used as an oxide semiconductor, a target to be used has a composition ratio expressed by the equation In:Zn=50:1 to 1:2 in atomic ratio ($In_2O_3$:ZnO=25:1 to 1:4 in molar ratio), preferably In:Zn=20:1 to 1:1 in atomic ratio ($In_2O_3$:ZnO=10:1 to 1:2 in molar ratio), more preferably In:Zn=1.5:1 to 15:1 in atomic ratio ($In_2O_3$:ZnO=3:4 to 15:2 to in molar ratio). For example, in a target used for formation of an In—Zn—O-based oxide semiconductor which has an atomic ratio of In:Zn:O=X:Y:Z, the relation of Z>1.5X+Y is satisfied.

For the source layer 1505*a* and the drain layer 1505*b*, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

A conductive film to be the source layer 1505*a* and the drain layer 1505*b* (including a wiring layer formed using the same layer as the source and drain layers) may be formed using a conductive metal oxide. As conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used.

For the insulating layer 1506, an insulator such as silicon oxide, silicon oxynitride, aluminum oxide, aluminum oxynitride, or gallium oxide can be used. A layered structure of these materials can also be used.

For the protective insulating layer 1507, an insulator such as silicon nitride, aluminum nitride, silicon nitride oxide, or aluminum nitride oxide can be used. A layered structure of these materials can also be used.

A planarization insulating film may be formed over the protective insulating layer 1507 in order to reduce surface roughness caused by a transistor. For the planarization insulating film, an organic material such as polyimide, acrylic, or benzocyclobutene can be used. Other than such organic materials, it is also possible to use a low-dielectric constant material (a low-k material) or the like. Note that the planarization insulating film may be formed by stacking a plurality of insulating films formed from these materials.

The liquid crystal display device disclosed in this specification can be formed using a transistor having the above-described structure. For example, a transistor including a semiconductor layer formed of amorphous silicon can be used in the pixel portion, and a transistor including a semiconductor layer formed of polycrystalline silicon or single crystal silicon can be used in the scan line driver circuit. Alternatively, a transistor including a semiconductor layer formed of an oxide semiconductor can be used in the pixel portion and the scan line driver circuit. In the case where transistors having the same structure are used in the pixel portion and the scan line driver circuit, reduction in cost and increase in yield due to reduction in the number of manufacturing steps can be achieved.

<Modification Example of Transistor>

FIG. 15 illustrates the transistor 1500 with a bottom-gate structure called a channel-etch structure; however, the transistor provided in the liquid crystal display device is not limited to having this structure. For example, transistors illustrated in FIGS. 16A to 16C can be employed.

Figure 16A:
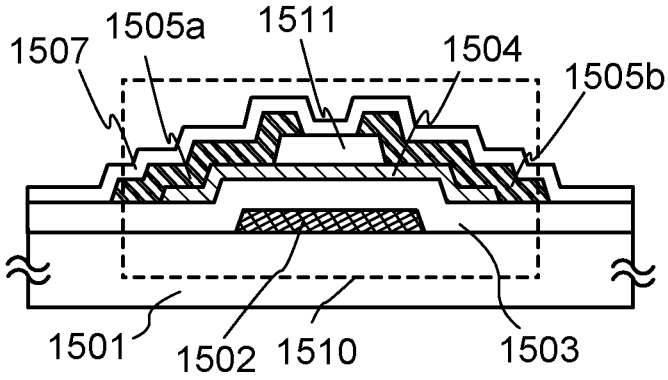
FIGS. 16A to 16C each illustrate a structural example of a transistor.

A transistor 1510 illustrated in FIG. 16A is one of bottom-gate transistors called a channel-protective type (also referred to as a channel-stop type) transistor.

The transistor 1510 includes, over the substrate 1501 having an insulating surface, the gate layer 1502, the gate insulating layer 1503, the semiconductor layer 1504, an insulating layer 1511 functioning as a channel protective layer that covers a channel formation region of the semiconductor layer 1504, the source layer 1505*a*, and the drain layer 1505*b*. Further, the protective insulating layer 1507 is formed so as to cover the source layer 1505*a*, the drain layer 1505*b*, and the insulating layer 1511.

As the insulating layer 1511, an insulator such as silicon oxide, silicon nitride, silicon oxynitride, silicon nitride oxide, aluminum oxide, tantalum oxide, or gallium oxide can be used. A layered structure of these materials can also be used.

Figure 16B:
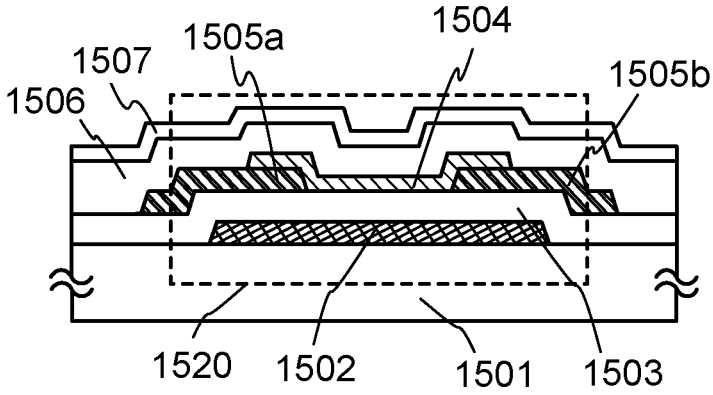

A transistor 1520 illustrate in FIG. 16B is a bottom-gate transistor. The transistor 1520 includes, over the substrate 1501 having an insulating surface, the gate layer 1502, the gate insulating layer 1503, the source layer 1505*a*, the drain layer 1505*b*, and the semiconductor layer 1504. Further, the insulating layer 1506 which covers the source layer 1505*a* and the drain layer 1505*b* and which is in contact with the semiconductor layer 1504 is provided. The protective insulating layer 1507 is provided over the insulating layer 1506.

In the transistor 1520, the gate insulating layer 1503 is provided on and in contact with the substrate 1501 and the gate layer 1502, and the source layer 1505*a* and the drain layer 1505*b* are provided on and in contact with the gate insulating layer 1503. The semiconductor layer 1504 is provided over the gate insulating layer 1503, the source layer 1505*a*, and the drain layer 1505*b*.

Figure 16C:
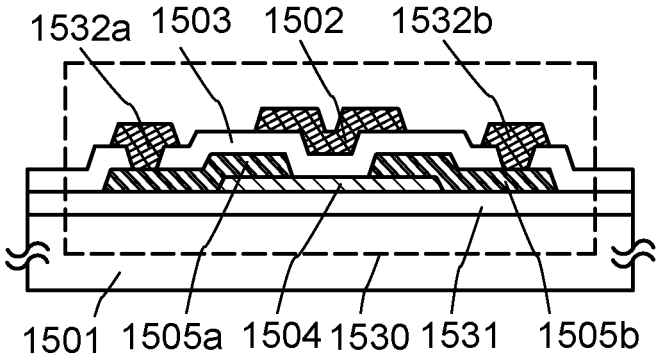

A transistor 1530 illustrated in FIG. 16C is one of top-gate transistors. The transistor 1530 includes, over the substrate 1501 having an insulating surface, an insulating layer 1531, the semiconductor layer 1504, the source layer 1505*a*, the drain layer 1505*b*, the gate insulating layer 1503, and the gate layer 1502. A wiring layer 1532*a* and a wiring layer 1532*b* are provided to be in contact with and electrically connected to the source layer 1505*a* and the drain layer 1505*b*, respectively.

As the insulating layer 1531, an insulator such as silicon oxide, silicon nitride, silicon oxynitride, silicon nitride oxide, aluminum oxide, tantalum oxide, or gallium oxide can be used. A layered structure of these materials can also be used.

As the wiring layers 1532*a* and 1532*b*, an element selected from aluminum (Al), copper (Cu), titanium (Ti), tantalum (Ta), tungsten (W), molybdenum (Mo), chromium (Cr), neodymium (Nd), and scandium (Sc); an alloy containing any of these elements; or a nitride containing any of these elements can be used. A layered structure of these materials can also be used.

Embodiment 4

In this embodiment, examples of an electronic appliance on which the above-described liquid crystal display device is mounted will be described with reference to FIGS. 17A to 17F.

Figure 17A:
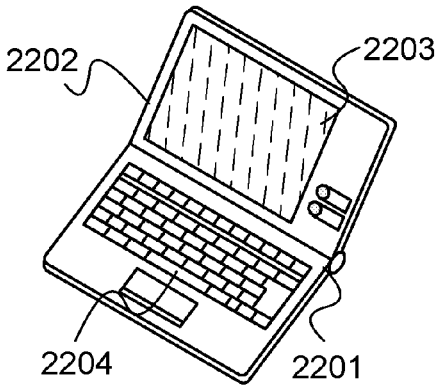
FIGS. 17A to 17F are views each illustrating an example of an electronic device.

FIG. 17A illustrates a laptop computer, which includes a main body 2201, a housing 2202, a display portion 2203, a keyboard 2204, and the like.

Figure 17B:
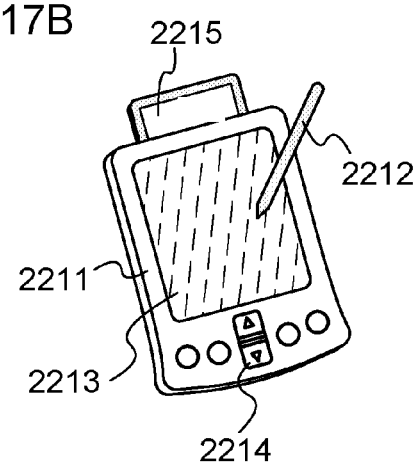

FIG. 17B illustrates a personal digital assistant (PDA), which includes a main body 2211 provided with a display portion 2213, an external interface 2215, an operation button 2214, and the like. A stylus 2212 for operation is included as an accessory.

Figure 17C:
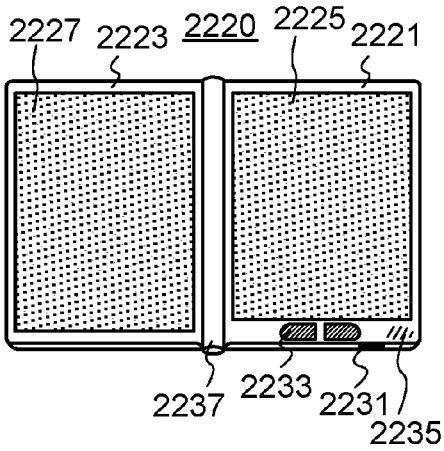

FIG. 17C illustrates an e-book reader 2220. The e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the structure where the display portions display different images from each other, for example, the right display portion (the display portion 2225 in FIG. 17C) can display text and the left display portion (the display portion 2227 in FIG. 17C) can display images.

Further, in FIG. 17C, the housing 2221 is provided with an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to various cables such as an AC adapter and a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Figure 17D:
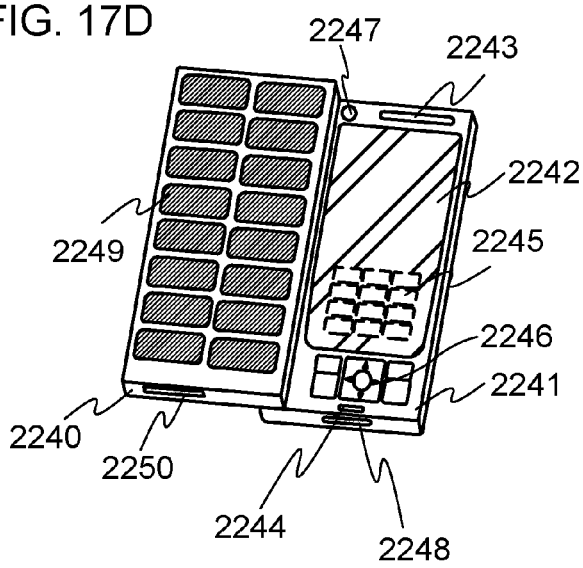

FIG. 17D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 charging of the mobile phone, an external memory slot 2250, and the like. An antenna is incorporated in the housing 2241.

The display panel 2242 has a touch panel function. A plurality of operation keys 2245 which is displayed as images is illustrated by dashed lines in FIG. 17D. Note that the mobile phone includes a booster circuit for increasing voltage output from the solar cell 2249 to voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc., as well as voice calls. Moreover, the housings 2240 and 2241 in a state where they are developed as illustrated in FIG. 17D can be slid so that one is lapped over the other; therefore, the size of the mobile phone can be reduced, which makes the mobile phone suitable for being carried.

The external connection terminal 2248 can be connected to an AC adapter or a variety of cables such as USB cables, so that electricity can be stored and data communication can be performed. Moreover, a larger amount of data can be saved and moved by inserting a recording medium to the external memory slot 2250. Further, in addition to the above functions, an infrared communication function, a television reception function, or the like may be provided.

Figure 17E:
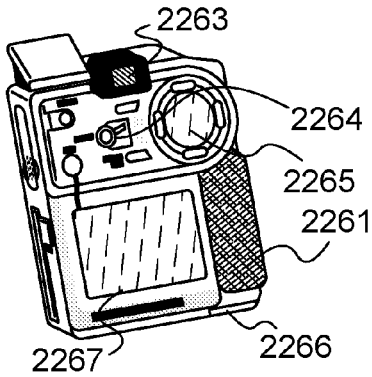

FIG. 17E illustrates a digital camera. The digital camera includes a main body 2261, a first display portion 2267, an eyepiece portion 2263, an operation switch 2264, a second display portion 2265, a battery 2266, and the like.

Figure 17F:
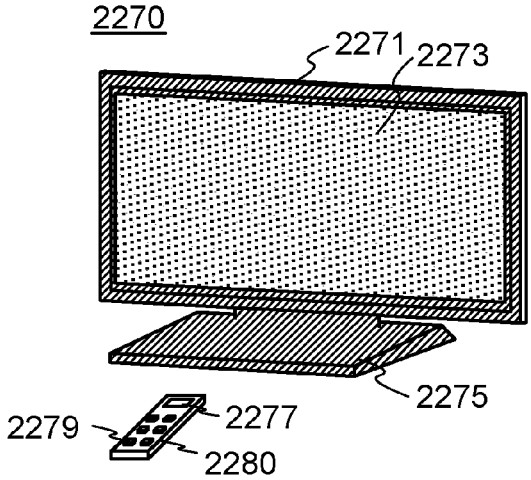

FIG. 17F illustrates a television set. In a television set 2270, a display portion 2273 is incorporated in a housing 2271. The display portion 2273 can display images. Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial No. 2010-136755 filed with the Japan Patent Office on Jun. 16, 2010, the entire contents of which are hereby incorporated by reference.

What is claimed is:

1. A driving method of a liquid crystal display device which forms an image in a pixel portion by repeatedly turning on and off a plurality of light sources which emit different colors and by controlling transmission of light of the different colors in each of a plurality of pixels provided in m rows and n columns (m and n are natural numbers that are 4 or more), the method comprising the steps of:

inputting an image signal for a first color and an image signal for a second color to the plurality of pixels in first to B-th rows (B is a natural number that is A/2 or less) and to the plurality of pixels in (A+1)th to (A+B)th rows (A is a natural number that is m/2 or less), respectively, in a period when the image signal for the first color and the image signal for the second color are input to the plurality of pixels in the first to A-th rows and to the plurality of pixels in the (A+1)th to 2A-th rows, respectively; and controlling transmission of light emitting the first color in the plurality of pixels in the first to the B-th rows and transmission of light emitting the second color in the plurality of pixels in the (A+1)th to the (A+B)th rows, wherein the light emitting the first color or the light emitting the second color is white light.

2. The driving method of a liquid crystal display device according to claim 1, wherein an image signal is input to the plurality of pixels provided in a C-th row (C is a natural number that is A or less) and a plurality of pixels provided in a (A+C)th row in different periods.

3. The driving method of a liquid crystal display device according to claim 1, wherein an image signal is input to the plurality of pixels provided in a C-th row (C is a natural number that is A or less) and a plurality of pixels provided in a (A+C)th row in a same period.

4. The driving method of a liquid crystal display device according to claim 1, wherein the liquid crystal display device is incorporated in one of a laptop computer, a personal digital assistant, an e-book reader, a mobile phone, a digital camera, and a television set.

5. A driving method of a liquid crystal display device which forms an image in a pixel portion by repeatedly turning on and off a plurality of light sources which emit different colors and by controlling transmission of light of the different colors in each of a plurality of pixels provided in m rows and n columns (m and n are natural numbers that are 4 or more), the method comprising the steps of:

inputting an image signal for a first color and an image signal for a second color to the plurality of pixels in first to B-th rows (B is a natural number that is A/2 or less) and to the plurality of pixels in (A+1)th to (A+B)th rows (A is a natural number that is m/2 or less), respectively, in a period when the image signal for the first color and the image signal for the second color are input to the plurality of pixels in the first to A-th rows and to the plurality of pixels in the (A+1)th to 2A-th rows, respectively; and controlling transmission of light emitting the first color in the plurality of pixels in the first to the B-th rows and transmission of light emitting the second color in the plurality of pixels in the (A+1)th to the (A+B)th rows, wherein the light emitting the first color or the light emitting the second color is white light, and wherein the white light is formed by emitting at least two light sources of the plurality of light sources at the same time.

6. The driving method of a liquid crystal display device according to claim 5, wherein an image signal is input to the plurality of pixels provided in a C-th row (C is a natural number that is A or less) and a plurality of pixels provided in a (A+C)th row in different periods.

7. The driving method of a liquid crystal display device according to claim 5, wherein an image signal is input to the plurality of pixels provided in a C-th row (C is a natural number that is A or less) and a plurality of pixels provided in a (A+C)th row in a same period.

8. The driving method of a liquid crystal display device according to claim 5, wherein the liquid crystal display device is incorporated in one of a laptop computer, a personal digital assistant, an e-book reader, a mobile phone, a digital camera, and a television set.

9. A driving method of a liquid crystal display device which forms an image in a pixel portion by repeatedly turning on and off a plurality of light sources which emit different colors and by controlling transmission of light of the different colors in each of a plurality of pixels provided in m rows and n columns (m and n are natural numbers that are 4 or more), the method comprising the steps of:

inputting an image signal for a first color and an image signal for a second color to the plurality of pixels in first to B-th rows (B is a natural number that is A/2 or less) and to the plurality of pixels in (A+1)th to (A+B)th rows (A is a natural number that is m/2 or less), respectively, in a period when the image signal for the first color and the image signal for the second color are input to the plurality of pixels in the first to A-th rows and to the plurality of pixels in the (A+1)th to 2A-th rows, respectively; and controlling transmission of light emitting the first color in the plurality of pixels in the first to the B-th rows and transmission of light emitting the second color in the plurality of pixels in the (A+1)th to the (A+B)th rows, wherein the light emitting the first color or the light emitting the second color is white light, and wherein the white light is formed by emitting one light source of the plurality of light sources.

10. The driving method of a liquid crystal display device according to claim 9, wherein an image signal is input to the plurality of pixels provided in a C-th row (C is a natural number that is A or less) and a plurality of pixels provided in a (A+C)th row in different periods.

11. The driving method of a liquid crystal display device according to claim 9, wherein an image signal is input to the plurality of pixels provided in a C-th row (C is a natural number that is A or less) and a plurality of pixels provided in a (A+C)th row in a same period.

12. The driving method of a liquid crystal display device according to claim 9, wherein the liquid crystal display device is incorporated in one of a laptop computer, a personal digital assistant, an e-book reader, a mobile phone, a digital camera, and a television set.

* * * * *